US009958796B2

(12) United States Patent
Yumita et al.

(10) Patent No.: US 9,958,796 B2
(45) Date of Patent: May 1, 2018

(54) ELECTROPHOTOGRAPHIC PHOTORECEPTOR, IMAGE FORMING METHOD, AND IMAGE FORMING APPARATUS

(71) Applicant: Konica Minolta, Inc., Tokyo (JP)

(72) Inventors: Masanori Yumita, Hachioji (JP); Hirofumi Hayata, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/442,846

(22) Filed: Feb. 27, 2017

(65) Prior Publication Data

US 2017/0261870 A1 Sep. 14, 2017

(30) Foreign Application Priority Data

Mar. 9, 2016 (JP) ..... 2016-045729

(51) Int. Cl.

| | |
|---|---|
| ***G03G 5/00*** | (2006.01) |
| ***G03G 5/047*** | (2006.01) |
| ***G03G 5/147*** | (2006.01) |
| ***G03G 5/05*** | (2006.01) |
| ***G03G 15/00*** | (2006.01) |

(52) U.S. Cl.

CPC ..... *G03G 5/047* (2013.01); *G03G 5/0539* (2013.01); *G03G 5/14708* (2013.01); *G03G 5/14713* (2013.01); *G03G 5/14726* (2013.01); *G03G 5/14786* (2013.01); *G03G 15/00* (2013.01); *G03G 15/75* (2013.01); *G03G 2215/0135* (2013.01)

(58) Field of Classification Search

CPC ..... G03G 5/14708; G03G 5/14713; G03G 5/14786

USPC ..... 430/66

See application file for complete search history.

(56) References Cited

U.S. PATENT DOCUMENTS

2010/0150606 A1* 6/2010 Tamoto ..... G03G 5/0614 399/111

FOREIGN PATENT DOCUMENTS

| | | | |
|---|---|---|---|
| JP | 2010107962 | A | 5/2010 |
| JP | 2013130603 | A | 7/2013 |

* cited by examiner

*Primary Examiner* — Mark A Chapman

(74) *Attorney, Agent, or Firm* — Lucas & Mercanti, LLP

(57) ABSTRACT

An electrophotographic photoreceptor includes an intermediate layer, a photosensitive layer, and a surface layer laminated on a conductive support in this order, wherein a cured product of a polymerizable monomer contains an electron transport agent and n-type metal oxide fine particles to which a reactive organic group is bonded in the surface layer.

10 Claims, 2 Drawing Sheets

ELECTROPHOTOGRAPHIC PHOTORECEPTOR, IMAGE FORMING METHOD, AND IMAGE FORMING APPARATUS

The entire disclosure of Japanese Patent Application No. 2016-045729 filed on Mar. 9, 2016 including description, claims, drawings, and abstract are incorporated herein by reference in its entirety.

BACKGROUND OF THE INVENTION

Field of the Invention

The present invention relates to an electrophotographic photoreceptor to be used in an electrophotographic image forming process, an image forming apparatus including the same, and an image forming method using the same.

Description of the Related Art

The electrophotographic photoreceptor (hereinafter, also simply referred to as the "photoreceptor") constituting an electrophotographic image forming apparatus such as a copying machine or a printer is required to have a long lifespan and image quality stability of the image to be formed. In the photoreceptor, the lifespan of the photoreceptor is determined depending on the wear of the photoreceptor surface.

In recent years, as a photoreceptor which exhibits excellent durability such as wear resistance and scratch resistance and achieves a long lifespan, a photoreceptor has been developed in which a photosensitive layer is laminated on a conductive support and a surface layer in which metal oxide fine particles to which a reactive organic group is bonded are bonded to a cured product of a polymerizable monomer via a bonding group by the reactive organic group is laminated on the photosensitive layer (JP 2010-107962 A).

However, the metal oxide fine particles exhibit low conductivity since an organic substance (bonding group by the reactive organic group) is present on the surface thereof, and a problem that the memory resistance of the surface layer decreases as the cancellation of the residual potential after exposure is hindered and image memories are generated is thus caused when such metal oxide fine particles are introduced into the surface layer.

In order to solve such a problem of the memory resistance, a method to contain a charge transport material in the surface layer is known, but another problem that the durability decreases since the charge transport material acts as a plasticizer in the surface layer is caused although a certain effect of improving the memory resistance is obtained in such a photoreceptor.

In order to achieve both durability and memory resistance, a method to obtain memory resistance while securing high durability by using p-type semiconductor fine particles as a charge transport material has been proposed (JP 2013-130603 A).

Meanwhile, it is considered that it is required to further increase the speed of an image forming apparatus in the future, but it cannot be said that sufficient memory resistance is achieved even if a photoreceptor having a surface layer using the p-type semiconductor fine particles is mounted on such a high-speed machine, and also a new quality defect called fogging is caused when the amount of p-type semiconductor fine particles is increased in order to improve memory resistance.

As described above, it is extremely difficult for a photoreceptor to be mounted on a high-speed image forming apparatus to achieve both high durability and excellent memory resistance.

SUMMARY OF THE INVENTION

The present invention has been made on the basis of such circumstances, and an object thereof is to provide an electrophotographic photoreceptor capable of achieving both high durability and excellent memory resistance even when being repeatedly used over a long period of time, an image forming apparatus including the same, and an image forming method using the same.

To achieve the abovementioned object, according to an aspect, an electrophotographic photoreceptor reflecting one aspect of the present invention comprises an intermediate layer, a photosensitive layer, and a surface layer laminated on a conductive support in this order, wherein a cured product of a polymerizable monomer contains an electron transport agent and n-type metal oxide fine particles to which a reactive organic group is bonded in the surface layer.

In the electrophotographic photoreceptor according to the aspect of the present invention, the n-type metal oxide fine particles preferably include at least one selected from the group consisting of tin oxide, titanium oxide, zinc oxide, indium oxide, and indium tin oxide.

In the electrophotographic photoreceptor according to the aspect of the present invention, a thickness of the surface layer is preferably from 1 to 10 μm.

In the electrophotographic photoreceptor according to the aspect of the present invention, the reactive organic group in the n-type metal oxide fine particles to which a reactive organic group is bonded is preferably a group having an unsaturated double bond.

In the electrophotographic photoreceptor according to the aspect of the present invention, the polymerizable monomer preferably has a group having an unsaturated double bond.

In the electrophotographic photoreceptor according to the aspect of the present invention, the electron transport agent preferably includes at least one selected from the group consisting of an oxadiazole derivative represented by the following general formula (1) or (2), a quinone derivative represented by the following general formula (3) or (4), a fluorene derivative represented by the following general formula (5), a tetracarboxylic acid diimide derivative represented by the following general formula (6), and silole derivatives represented by the following general formulas (7) to (9).

[Chemical Formula 1]

General formula (1)

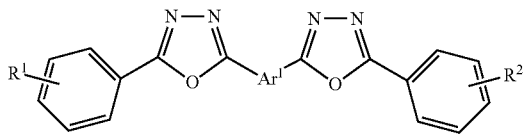

General formula (2)

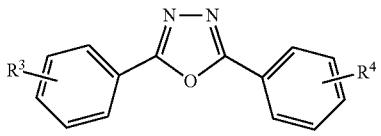

-continued

General formula (3)

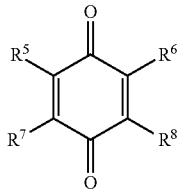

General formula (4)

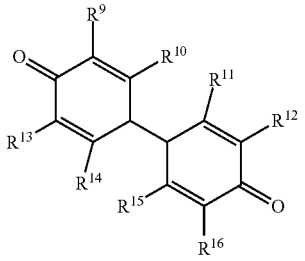

General formula (5)

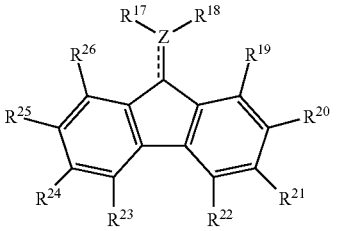

General formula (6)

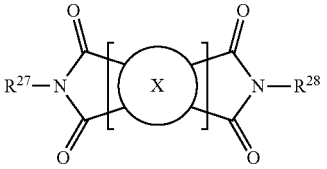

Formula (x1)

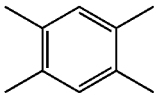

Formula (x2)

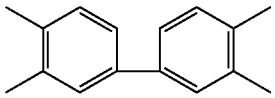

Formula (x3)

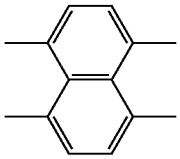

Formula (x4)

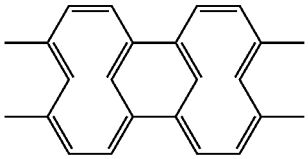

Formula (x5)

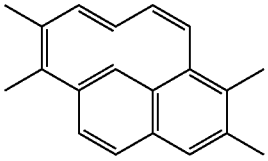

-continued

General formula (7)

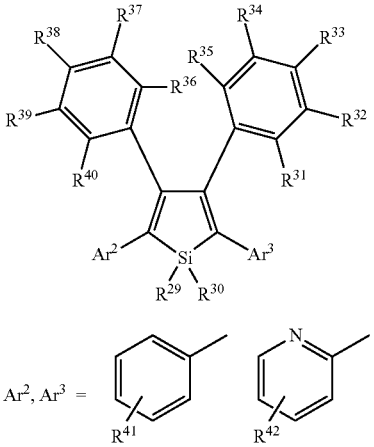

General formula (8)

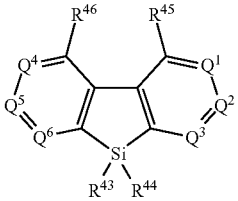

General formula (9)

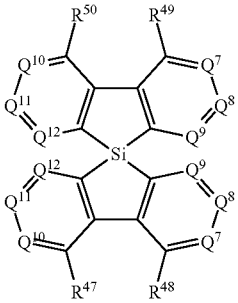

[In the general formula (1), $R^1$ and $R^2$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group), and $Ar^1$ represents an arylene group which may have a substituent.

In the general formula (2), $R^3$ and $R^4$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group).

In the general formula (3), $R^5$ to $R^8$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group).

In the general formula (4), $R^9$ to $R^{16}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group).

In the general formula (5), $R^{17}$ and $R^{18}$ each independently represent a group selected from the group consisting of a hydrogen atom, a nitrile group, and an alkoxycarbonyl group which has from 1 to 8 carbon atoms and may have a substituent, at least either of them is a nitrile group or an alkoxycarbonyl group which has from 1 to 8 carbon atoms and may have a substituent, $R^{19}$ to $R^{26}$ each independently represent a group selected from the group consisting of a hydrogen atom, an alkyl group which has from 1 to 8 carbon atoms and may have a substituent, an aryl group which may have a substituent, and an alkoxycarbonyl group which has from 1 to 8 carbon atoms and may have a substituent, and Z represents a carbon atom or a nitrogen atom.

In the general formula (6), $R^{27}$ and $R^{28}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, and a hydroxyl group, X is any of tetravalent groups represented by the formulas (x1) to (x5) and may have at least one substituent selected from the group consisting of an alkyl group which has from 1 to 8 carbon atoms and may have a substituent, an alkoxy group which has from 1 to 8 carbon atoms and may have a substituent, a halogen atom, an aryl group which has from 6 to 18 carbon atoms and may have a substituent, a cyano group, a nitro group, and a hydroxyl group.

In the general formula (7), $R^{29}$ and $R^{30}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, an aryl group which has from 6 to 18 carbon atoms and may have a substituent, a cyano group, and a nitro group, these may be linked to each other to have a ring structure, $R^{31}$ to $R^{40}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group), and $R^{41}$ and $R^{42}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, and a halogen atom.

In the general formula (8), $R^{43}$ and $R^{44}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, an aryl group which has from 6 to 18 carbon atoms and may have a substituent, a cyano group, and a nitro group, these may be linked to each other to have a ring structure, $R^{45}$ and $R^{46}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and a heteroaryl group which may have a substituent, and $Q^1$ to $Q^6$ each independently represent a carbon atom or a nitrogen atom.

In the general formula (9), $R^{47}$ to $R^{50}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and a heteroaryl group which may have a substituent, and $Q^7$ to $Q^{12}$ each independently represent a carbon atom or a nitrogen atom.]

To achieve the abovementioned object, according to an aspect, an image forming method reflecting one aspect of the present invention uses a charging method to negatively charge the electrophotographic photoreceptor described above.

To achieve the abovementioned object, according to an aspect, an image forming apparatus reflecting one aspect of the present invention comprises the electrophotographic photoreceptor described above.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described specifically with reference to the drawings. However, the scope of the invention is not limited to the illustrated examples.

[Photoreceptor]

The photoreceptor according to an embodiment of the present invention is a photoreceptor to be mounted on an image forming apparatus including a charging unit, an exposure unit, a developing unit, a transfer unit, and a cleaning unit, and it is an organic photoreceptor in which an intermediate layer, a photosensitive layer, and a surface layer are laminated on a conductive support in this order.

In the embodiment of the present invention, the term "organic photoreceptor" refers to one having a configuration in which at least one function of a charge generating function and a charge transporting function which are indispensable for configuration of the photoreceptor is exerted by an organic compound, and it includes all the known organic photoreceptors such as a photoreceptor having an organic photosensitive layer composed of a known organic charge generating material or organic charge transport material, a photoreceptor having an organic photosensitive layer in which the charge generating function and charge transporting function are configured by a polymer complex.

Figure 1:
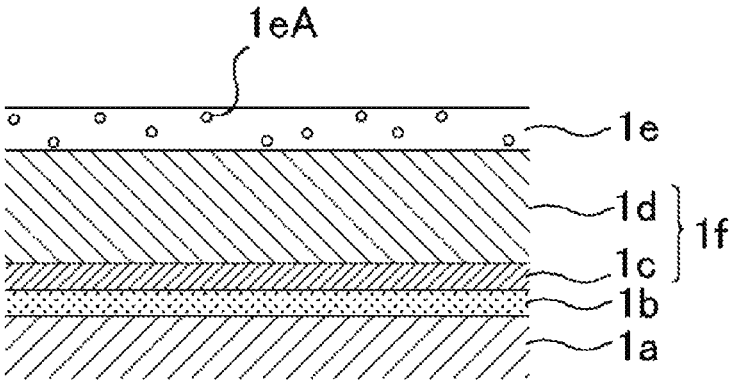
FIG. 1 is a partial cross-sectional diagram illustrating an example of a layer configuration of an electrophotographic photoreceptor according to an embodiment of the present invention.

For example, as illustrated in FIG. 1, the photoreceptor is one in which an intermediate layer 1*b*, a charge generating layer 1*c*, a charge transport layer 1*d*, and a surface layer 1*e* are laminated on a conductive support 1*a* in this order, and a photosensitive layer if is constituted by the charge generating layer 1*c* and the charge transport layer 1*d*.

[Surface Layer 1*e*]

In the surface layer 1*e* constituting the photoreceptor according to the embodiment of the present invention contains a binder resin (hereinafter, also referred to as the "binder resin for surface layer") that is a cured product of a polymerizable monomer contains an electron transport agent and n-type metal oxide fine particles 1*e*A to which a reactive organic group is bonded (hereinafter, also referred to as the "specific n-type metal oxide fine particles").

According to the photoreceptor as described above, basically a high film hardness is obtained as the surface layer 1*e* is basically composed of a cured product of a polymerizable monomer and also a filler effect and an even higher film hardness are obtained as the surface layer 1*e* contains n-type metal oxide fine particles, and high durability is thus obtained.

Moreover, according to this photoreceptor, excellent memory resistance is obtained since the degree of variation in residual potential is suppressed low even when this photoreceptor is repeatedly used over a long period of time. This is presumed because as the surface layer 1*e* contains an electron transport agent and n-type metal oxide fine particles to which a reactive organic group is bonded, the residual potential after exposure can be moved in the direction of the charge transport layer 1*d* since high electron transport property is exerted in the surface layer 1*e* and this residual potential (negative charge) after exposure can be easily canceled by holes (positive holes) derived from the charge generating layer 1*c*.

In addition, in the photoreceptor according to the embodiment of the present invention, the electrostatic latent image is formed in the boundary region between the surface layer 1*e* and the photosensitive layer if, and image defects due to the scratches formed on the surface of the surface layer 1*e* are thus hardly generated, and as a result, excellent image stability can be obtained over a long period of time.

[Specific n-Type Metal Oxide Fine Particles 1*e*A]

The specific n-type metal oxide fine particles 1*e*A according to the embodiment of the present invention have a reactive organic group introduced into the surface, and specifically, they are one prepared by treating the surface of the untreated n-type metal oxide fine particles (hereinafter, also referred to as the "raw material n-type metal oxide fine particles") to be a raw material with a surface treatment agent having a reactive organic group.

[Raw Material n-Type Metal Oxide Fine Particles]

The raw material n-type metal oxide fine particles are semiconductor particles in which a carrier for transporting a charge is an electron, and they contribute to image quality stability such as memory resistance.

The raw material n-type metal oxide fine particles are preferably composed of at least one selected from the group consisting of tin oxide, titanium oxide, zinc oxide, indium oxide, and indium tin oxide (ITO), and it is particularly preferable to use tin oxide from the viewpoint of hardness, conductivity, and optical transparency of the surface layer 1*e* to be obtained. These raw material n-type metal oxide fine particles may be used singly or as a mixture of two or more kinds thereof.

As the raw material n-type metal oxide fine particles, those fabricated by general methods such as a vapor phase method, a chlorine method, a sulfuric acid method, a plasma method, and an electrolytic method can be used.

[Surface Treatment of Raw Material n-Type Metal Oxide Fine Particles]

Examples of the surface treatment agent to be used for the surface treatment of the raw material n-type metal oxide fine particles may include a silane coupling agent having a reactive organic group and a titanium coupling agent. The reactive organic group is preferably a group having an unsaturated double bond, and specifically it is preferably an acryloyl group or a methacryloyl group.

The specific n-type metal oxide fine particles 1*e*A have a reactive organic group by using a silane coupling agent having a reactive organic group, such specific n-type metal oxide fine particles 1*e*A are firmly fixed since they chemically bond with the polymerizable compound by being polymerized with the polymerizable compound at the time of forming a binder resin for surface layer that is a cured product of a polymerizable monomer, and as a result, it is possible to form the surface layer 1*e* having high durability.

Examples of the silane coupling agent having an acryloyl group or a methacryloyl group may include known compounds as to be described below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$

S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

As the surface treatment agent, it is possible to use a silane compound which has a reactive organic group and can be subjected to a radical polymerization reaction in addition to S-1 to S-36 described above. These surface treatment agents may be used singly or as a mixture of two or more kinds thereof.

In addition, the amount of the surface treatment agent used is not particularly limited, but it is preferably from 0.1 to 100 parts by mass with respect to 100 parts by mass of the raw material n-type metal oxide fine particles.

The number average primary particle diameter of the specific n-type metal oxide fine particles 1*e*A is preferably from 1 to 300 nm and more preferably from 3 to 100 nm.

It is concerned that sufficient wear resistance is not obtained in a case in which the number average primary particle diameter of the specific n-type metal oxide fine particles 1*e*A is less than 1 nm. It is concerned that specific writing light is scattered by the fine particles or sufficient wear resistance is not obtained as the photocuring is inhibited by the fine particles, and as a result, there is a tendency that the photoreceptor cannot be used over a long period of time in a case in which the number average primary particle diameter of the specific n-type metal oxide fine particles 1*e*A exceeds 300 nm.

With regard to the number average primary particle diameter of the specific n-type metal oxide fine particles 1*e*A, a photograph of the specific n-type metal oxide fine particles 1*e*A enlarged by 100,000-fold is taken by the scanning electron microscope "JSM-7500F" (manufactured by JEOL Ltd.), the photographic image (excluding aggregated particles) obtained by scanning the photograph by a scanner is subjected to the binarization processing for the specific n-type metal oxide fine particles 1*e*A using the automatic image processing and analysis system "LUZEX (registered trademark) AP (software Ver. 1.32)" (developed by Nireco Corporation) to calculate the Feret's diameter in the horizontal direction of arbitrary 100 specific n-type metal oxide fine particles 1*e*A, and the average value thereof is adopted as the number average primary particle diameter. Here, the Feret's diameter in the horizontal direction refers to the length of a side parallel to the x axis of the bounding rectangle when the image of the specific n-type metal oxide fine particles 1*e*A is subjected to the binarization processing.

The specific n-type metal oxide fine particles 1*e*A are contained at a proportion of preferably from 10 to 200 parts by mass and more preferably from 50 to 120 parts by mass with respect to 100 parts by mass of the binder resin for surface layer.

The hardness of the surface layer 1*e* can be appropriately adjusted as well as the surface layer 1*e* obtains appropriate electron transport property as the proportion of the specific n-type metal oxide fine particles 1*e*A contained is in the range.

[Electron Transport Agent]

It is preferable that the electron transport agent is composed of at least one selected from the group consisting of an oxadiazole derivative represented by the general formula (1) or (2), a quinone derivative represented by the general formula (3) or (4), a fluorene derivative represented by the general formula (5), a tetracarboxylic acid diimide derivative represented by the general formula (6), and silole derivatives represented by the general formulas (7) to (9). These electron transport agents may be used singly or as a mixture of two or more kinds thereof.

In the general formula (1), $R^1$ and $R^2$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group) such as —C(=O)—$OR^b$ (provided that $R^b$ is a monovalent organic group), and $Ar^1$ represents an arylene group which may have a substituent.

In the general formula (2), $R^3$ and $R^4$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group) such as —C(=O)—$OR^b$ (provided that $R^b$ is a monovalent organic group).

In the general formula (3), $R^5$ to $R^8$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group) such as —C(=O)—$OR^b$ (provided that $R^b$ is a monovalent organic group).

In the general formula (4), $R^9$ to $R^{16}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group) such as —C(=O)—$OR^b$ (provided that $R^b$ is a monovalent organic group).

In the general formula (5), $R^{17}$ and $R^{18}$ each independently represent a group selected from the group consisting of a hydrogen atom, a nitrile group, and an alkoxycarbonyl group which has from 1 to 8 carbon atoms and may have a substituent, at least either of them is a nitrile group or an alkoxycarbonyl group which has from 1 to 8 carbon atoms and may have a substituent, $R^{19}$ to $R^{26}$ each independently represent a group selected from the group consisting of a hydrogen atom, an alkyl group which has from 1 to 8 carbon atoms and may have a substituent, an aryl group which may have a substituent, and an alkoxycarbonyl group which has from 1 to 8 carbon atoms and may have a substituent, and Z represents a carbon atom or a nitrogen atom.

In the general formula (6), $R^{27}$ and $R^{28}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, and a hydroxyl group, X is any of tetravalent groups represented by the formulas (x1) to (x5) and may have at least one substituent selected from the group consisting of an alkyl group which has from 1 to 8 carbon atoms and may have a substituent, an alkoxy group which has from 1 to 8 carbon atoms and may have a substituent, a halogen atom, an aryl group which has from 6 to 18 carbon atoms and may have a substituent, a cyano group, a nitro group, and a hydroxyl group.

In the general formula (7), $R^{29}$ and $R^{30}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, an aryl group which has from 6 to 18 carbon atoms and may have a substituent, a cyano group, and a nitro group, these may be linked to each other to have a ring structure, $R^{31}$ to $R^{40}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group) such as —C(=O)—$OR^b$ (provided that $R^b$ is a monovalent organic group), and $R^{41}$ and $R^{42}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, and a halogen atom.

In the general formula (8), $R^{43}$ and $R^{44}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, an aryl group which has from 6 to 18 carbon atoms and may have a substituent, a cyano group, and a nitro group, these may be linked to each other to have a ring structure, $R^{45}$ and $R^{46}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and a heteroaryl group which may have a substituent, and $Q^1$ to $Q^6$ each independently represent a carbon atom or a nitrogen atom.

In the general formula (9), $R^{47}$ to $R^{50}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and a heteroaryl group which may have a substituent, and $Q^7$ to $Q^{12}$ each independently represent a carbon atom or a nitrogen atom.

Examples of the oxadiazole derivative represented by the general formula (1) may include the following formulas (ETM101) and (ETM102), examples of the oxadiazole derivative represented by the general formula (2) may include the following formulas (ETM103) and (ETM104), examples of the quinone derivative represented by the general formula (3) may include the following formula (ETM201), examples of the quinone derivative represented by the general formula (4) may include the following formula (ETM202), examples of the fluorene derivative represented by the general formula (5) may include the following formula (ETM301), examples of the tetracarboxylic acid diimide derivative represented by the general formula (6) may include the following formulas (ETM401) to (ETM405), examples of the silole derivative represented by the general formula (7) may include the following formula (ETM501), examples of the silole derivative represented by the general formula (8) may include the following formula (ETM502), and examples of the silole derivative represented by the general formula (9) may include the following formula (ETM503).

[Chemical Formula 2]

Formula (ETM101)

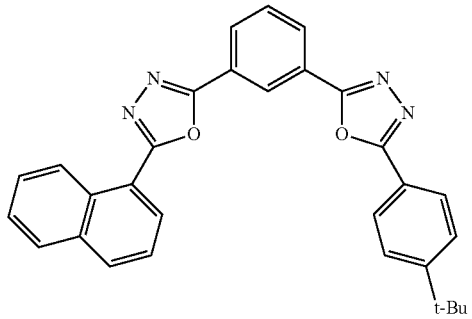

Formula (ETM102)

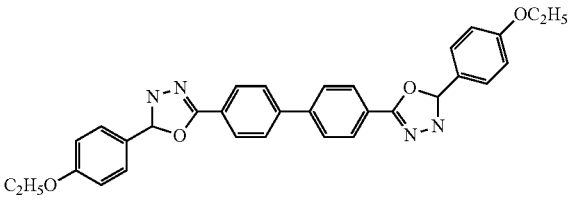

Formula (ETM103)

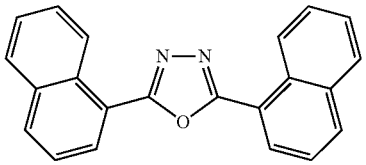

-continued
Formula (ETM104)
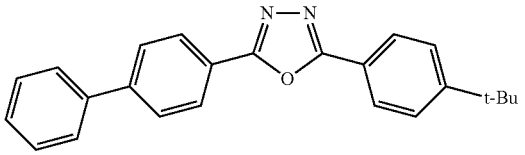
Formula (ETM201)
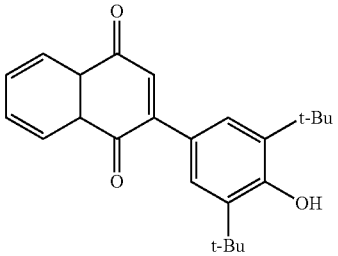
Formula (ETM202)
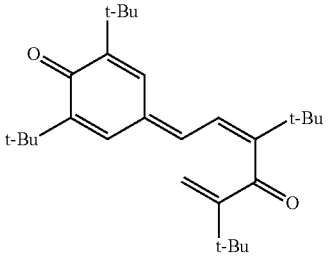
Formula (ETM301)
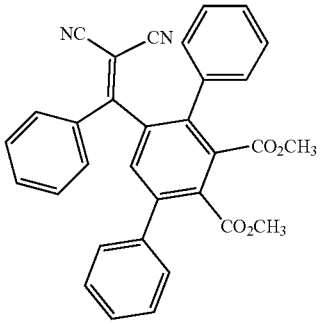
Formula (ETM401)
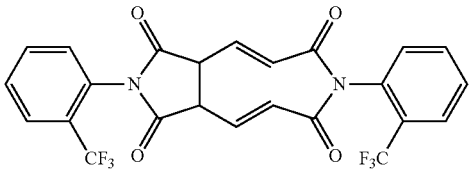
Formula (ETM402)
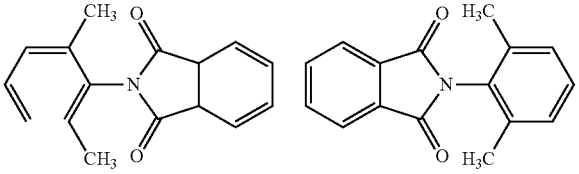
-continued
Formula (ETM403)
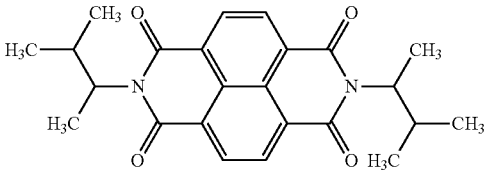
Formula (ETM404)
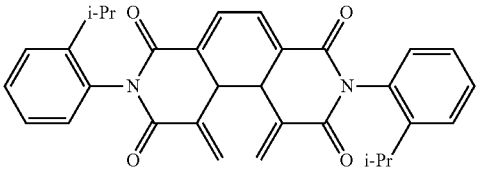
Formula (ETM405)
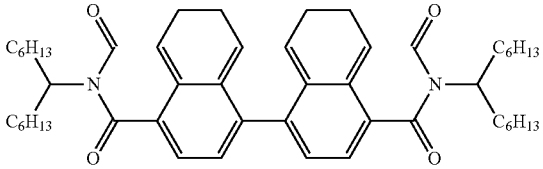
[Chemical Formula 3]
Formula (ETM501)
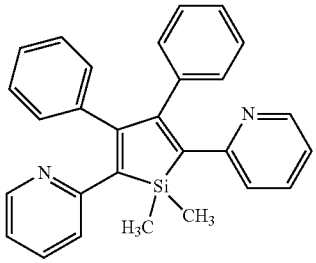
Formula (ETM502)
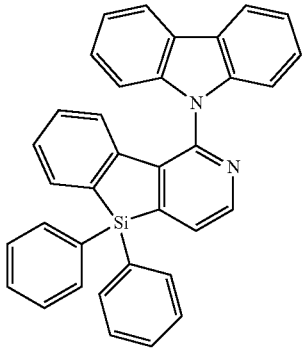

-continued

Formula (ETM503)

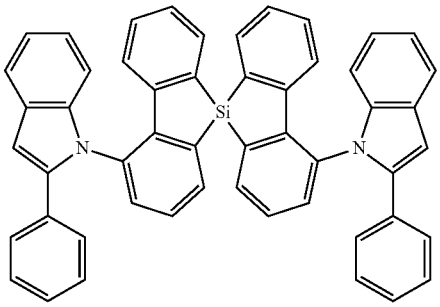

The oxadiazole derivative represented by the general formula (1) can be synthesized, for example, by the methods disclosed in the literatures such as "Synthesis, 1986, #5, pp. 411-413, Rekkas" and "J. Org. Chem., 2009, 74 (16) pp. 6410-6413, Tomoya Mukai et al.".

Specifically, the compound represented by the formula (ETM101) can be synthesized by using 4-tert-butylbenzonitrile as a starting material, converting the cyano group into a tetrazole group, and then coupling this with 3-cyanobenzonitrile chloride, converting the cyano group in the material thus obtained into a tetrazole group in the same manner, and then coupling this with 1-naphthoyl chloride.

In addition, the compound represented by the formula (ETM102) can be synthesized by reacting 10 parts by mass of biphenyl-4,4'-dicarboxylic acid dichloride with 13.9 parts by mass of 4-ethoxybenzohydrazide in anhydrous pyridine, putting the reaction mixture in pure water, filtering the precipitate, washing this precipitate with dilute hydrochloric acid and pure water, then recrystallizing this precipitate in a mixed solvent of methanol/ethanol, reacting 15 parts by mass of the needle crystal thus obtained in 812 parts by mass of phosphorus oxychloride while refluxing, and then distilling off phosphorus oxychloride, then thoroughly washing the reaction product with water and methanol, and subsequently recrystallizing this in a mixed solvent of ethanol/toluene.

The compound (2,5-bis(1-naphthyl)-1,3,4-oxadiazole) represented by the formula (ETM103) and the compound (2-(4-tert-butylphenyl)-5-(4-biphenylyl)-1,3,4-oxadiazole) represented by the formula (ETM104) are available as commercial products.

The compound represented by the formula (ETM201) can be synthesized in accordance with "Archin der Pharmazie, 1991, vol. 324, #8, pp. 491-495. Wurm et al.".

In addition, the compound (3,3',5,5'-tetra-t-butyldiphenoquinone) represented by the formula (ETM202) is available as a commercial product.

The compound represented by the formula (ETM301) can be synthesized as follows. To ethanol, 100 parts by mass of ninhydrin and 118 parts by mass of benzyl ketone are added and heated to reflux, a solution prepared by dissolving 9.5 parts by mass of potassium hydroxide in methanol is added to the refluxing reaction liquid dropwise over 1 hour, after the dropwise addition, refluxing and stirring are conducted for 1 hour, the reaction mixture is left to cool to precipitate a crystal, and the crystal is separated through filtration, washed with methanol, and then recrystallized in acetonitrile. In a flask, 130 parts by mass of the crystal thus obtained and 82.9 parts by mass of dimethyl acetylenedicarboxylate are put, the external temperature is set to 160° C., the reaction liquid is heated so that the internal temperature reaches 130° C. or higher, and heated and stirred for 2 hours, the reaction mixture is then left to cool, the precipitated crystal is separated through filtration, ethanol and toluene are added to the crude crystal thus obtained to recrystallize. To THF, 155 parts by mass of the crystal thus obtained and 45.7 parts by mass of malononitrile are added and cooled at an external temperature of −10° C., 328 parts by mass of titanium tetrachloride dissolved in carbon tetrachloride is then added thereto dropwise at an internal temperature of 0° C.±5° C., the mixture is stirred for 30 minutes at the same temperature, 274 parts by mass of pyridine is then added thereto, and the temperature is gradually returned to room temperature, the mixture is further heated to reflux, and reacted for 8 hours in a refluxed state, the temperature is then returned to room temperature, the reaction liquid is added to pure water, toluene is further added thereto, the toluene layer is extracted by liquid separation, the toluene layer is washed with dilute hydrochloric acid, and the aqueous layer is then washed with water until the pH thereof becomes neutral, the toluene layer is then concentrated through distillation under reduced pressure, a mixed solution of toluene and ethanol is added thereto for recrystallization, and the crystal thus obtained is separated through filtration, and recrystallized again.

The tetracarboxylic acid diimide derivative represented by the general formula (6) can be synthesized by the method disclosed in the literatures such as "Monatshefte fuer Chemie, 1914, vol. 35". In general, it can be synthesized by heating and stirring tetracarboxylic dianhydride and an aniline derivative in an aprotic polar solvent such as dimethylformamide to react them, and recrystallizing, then purify by column chromatography or the like, and drying the reaction product. In addition, for example, those in which the group X in the tetracarboxylic acid diimide derivative represented by the general formula (6) is a naphthalene ring can be synthesized by the methods disclosed in JP 2001-265031 A, "J. Am. Chem. Soc., 120323 (1) (1998)", and "Journal of Organic Chemistry, 2007, vol. 72, #19, pp. 7287-7293". Specifically, it can be synthesized by simultaneously or sequentially reacting a naphthalene-1,4,5,8-tetracarboxylic dianhydride derivative, a 1,1-disubstituted hydrazine derivative, and a substituted amine derivative in the presence or absence of a solvent.

Specifically, the compound represented by the formula (ETM401) can be synthesized by heating 300 parts by mass of pyromellitic dianhydride and 560 parts by mass of 2-(trifluoromethyl)aniline in dimethylformamide for 3 hours under reflux, cooling and then filtering the reaction mixture, washing the precipitate with dimethylformamide, further washing it with an ether, and drying it, and purifying the product thus obtained.

In addition, the compound represented by the formula (ETM402) can be synthesized by the same method as the step of synthesizing the compound represented by the formula (ETM401) described above except that 310 parts by mass of 2,6-dimethylaniline is used instead of 560 parts by mass of 2-(trifluoromethyl)aniline as well as 3,3',4,4'-biphenyltetracarboxylic dianhydride is used instead of pyromellitic dianhydride.

In addition, the compound represented by the formula (ETM403) can be synthesized by the same method as the step of synthesizing the compound represented by the formula (ETM401) described above except that 300 parts by mass of 1,2-dimethylpropylamine is used instead of 560 parts by mass of 2-(trifluoromethyl)aniline.

In addition, the compound represented by the formula (ETM404) can be synthesized by the same method as the step of synthesizing the compound represented by the formula (ETM401) described above except that 600 parts by mass of pentyl 4-aminocyclohexanecarboxylate is used instead of 560 parts by mass of 2-(trifluoromethyl)aniline as well as naphthalene-1,4,5,8-tetracarboxylic dianhydride is used instead of pyromellitic dianhydride.

In addition, the compound represented by the formula (ETM405) can be synthesized by the same method as the step of synthesizing the compound represented by the formula (ETM401) described above except that 390 parts by mass of 1-hexylheptylamine is used instead of 560 parts by mass of 2-(trifluoromethyl)aniline as well as perylene-3,4,9,10-tetracarboxylic dianhydride is used instead of pyromellitic dianhydride.

The silole derivatives represented by the general formulas (7) to (9) can be synthesized, for example, by the methods disclosed in the literatures such as (a) Science 1998, 282, pp. 913-915, (b) J. Org. Chem., 2002, Vol. 67, pp. 9392-9396, (c) J. Org. Chem., 2006, VOL. 71, pp. 7826-7834, (d) J. Am. Chem. Soc., VOL. 124, No. 1, 2002, pp. 49-57, (e) WO 2006/002731, pp. 15, (f) J.C.S., [Section] B, Physical Organic 1996, pp. 733-735, and (g) Chem. Lett., 1982, pp. 1195-1198.

Specifically, the compound represented by the formula (ETM501) can be synthesized in accordance with "Chemistry-A European Journal, 2000, vol. 6, #9, pp. 1683-1692, Yamaguchi, Shigehiro et al.".

In addition, the compound represented by the formula (ETM502) can be synthesized as follows. In other words, 23.4 parts by mass of 3-(2-bromophenyl)pyridine synthesized according to the method disclosed in JP 2013-20996 A is dissolved in acetic acid, 113.4 parts by mass of 30% hydrogen peroxide is added to the solution, the mixture is heated and stirred at 95° C. for 5 hours, the reaction liquid is concentrated to about 90% under reduced pressure, 1% sodium bicarbonate water is added to the residue, the organic layer is extracted with ethyl acetate, washed with saturated saline solution three times, and concentrated under reduced pressure, chloroform is added to the residue, 43.0 parts by mass of phosphorus oxybromide is added to the mixture, the mixture is heated and refluxed for 3 hours, the solvent and excess phosphorus oxybromide are distilled off under reduced pressure, the residue is recrystallized in toluene. In a dehydrated ether, 25.0 parts by mass of the crystal thus obtained is dissolved, the internal temperature of the solution is lowered to −75° C., subsequently 75.1 parts by mass of a 1.6 M n-butyllithium/hexane solution is gradually added to the solution while keeping the internal temperature at −70° C. or lower, the mixture is then stirred at the same temperature for 2 hours, thereafter, a solution prepared by dissolving 21.2 parts by mass of dichlorodiphenylsilane in a dehydrated ether is gradually added to the mixture while keeping the internal temperature at −65° C. or lower. The mixture is stirred at the same temperature for 3 hours, warmed up to room temperature by the course of nature, and further stirred for 2 hours. After the reaction is completed, the solvent is distilled off under reduced pressure, and the residue is recrystallized in a mixed solvent of methylene chloride and ethanol. In acetic acid, 20.0 parts by mass of the crystal thus obtained is dissolved, 67.6 parts by mass of 30% hydrogen peroxide is added to the solution, the mixture is heated and stirred at 95° C. for 5 hours, the reaction liquid is concentrated to about 90% under reduced pressure, 1% sodium bicarbonate water is added to the residue, the organic layer is extracted with ethyl acetate, washed three times with saturated saline solution, and concentrated under reduced pressure, chloroform is added to the residue, 25.6 parts by mass of phosphorus oxybromide is added to the mixture, the mixture is heated and refluxed for 3 hours, the solvent and excess phosphorus oxybromide are distilled off under reduced pressure, and the residue is recrystallized in toluene. In dimethylacetamide (DMAc), 23.0 parts by mass of the crystal thus obtained is dissolved, 34.1 parts by mass of carbazole, 23.3 parts by mass of copper iodide, 16.9 parts by mass of potassium carbonate, 1.3 parts by mass of L-proline are added to the solution, and the mixture is heated and stirred at an internal temperature of 150° C. for 6 hours under a nitrogen stream. After the reaction is completed, the solvent is distilled off under reduced pressure, and the residue is purified by silica gel column chromatography (eluent=heptane:methylene chloride=9:1). In this manner, the compound represented by the formula (ETM502) can be synthesized.

In addition, the compound represented by the formula (ETM503) can be synthesized according to the method disclosed in Synthesis Example 7 of JP 2013-20996 A.

The electron transport agent is not limited to the compounds represented by the general formulas (1) to (9) described above, and for example, it is also possible to use a compound represented by the following formula (ETM-A) or the like.

The compound represented by the following formula (ETM-A) can be synthesized according to the method disclosed in JP 4807838 B1.

[Chemical Formula 4]

Formula (ETM-A)

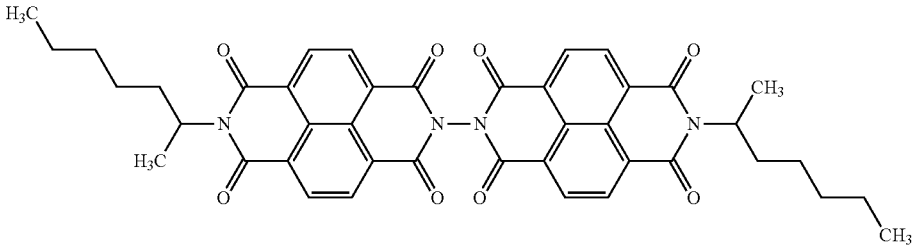

The electron transport agent is contained at a proportion of preferably from 0.1 to 50 parts by mass and more preferably from 1 to 10 parts by mass with respect to 100 parts by mass of the binder resin for surface layer.

The surface layer 1*e* obtains appropriate electron transport property as the proportion of the electron transport agent contained is in the above range.

[Binder Resin for Surface Layer]

The binder resin for surface layer is a cured product of a polymerizable monomer, and it is more preferably a photocurable resin particularly since a high film strength is obtained.

As the binder resin for surface layer, for example, it is possible to use a polyvinyl butyral resin, an epoxy resin, a polyurethane resin, a phenol resin, a polyester resin, an alkyd resin, a polycarbonate resin, a silicone resin, an acrylic resin, and a melamine resin.

It is preferably a polycarbonate resin in the case of using a thermoplastic resin.

In addition, it is preferably a crosslinkable polymerizable compound, specifically, a cured product that is a polymerization reaction product of a compound having two or more radical polymerizable functional groups (hereinafter, also referred to as the "polyfunctional radical polymerizable compound") by radiation of an active ray such as ultraviolet light or an electron beam in the case of using a photocurable resin. The radical polymerizable functional group is regarded to contain an unsaturated double bond.

Those mentioned as the binder resin for surface layer may be used singly or in combination of two or more kinds thereof.

[Polyfunctional Radically Polymerizable Compound]

As the polyfunctional radically polymerizable compound, an acrylic monomer having two or more acryloyl groups ($CH_2{=}CHCO{-}$) or methacryloyl groups ($CH_2{=}CCH_3CO{-}$) as the radical polymerizable functional group or an oligomer thereof is particularly preferable since it can be cured with a small amount of light or in a short time. Accordingly, it is preferable that the cured product is an acrylic resin formed of an acrylic monomer or an oligomer thereof.

Examples of these polyfunctional radically polymerizable compounds may include the following compounds.

[Chemical Formula 5]

M1

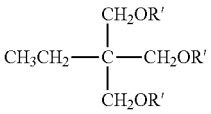

M2

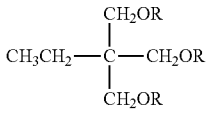

M3

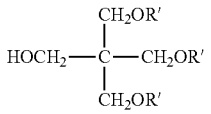

M4

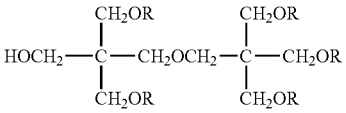

M5

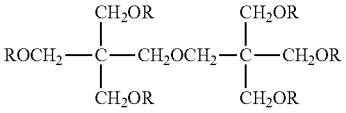

-continued

M6

$$CH_3CH_2C{-}(CH_2OC_3H_6OR)_3$$

M7

$$CH_3CH_2C{-}(CH_2CH_2OR)_3$$

[Chemical Formula 6]

M8

$$R{-}(OC_3H_6)_3{-}OR$$

M9

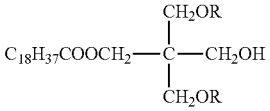

M10

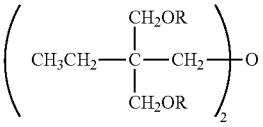

M11

$$(ROCH_2)_4{-}C$$

M12

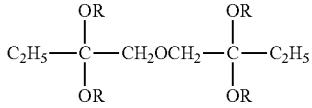

M13

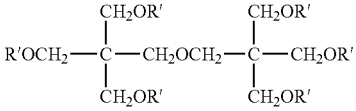

M14

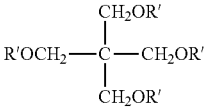

M15

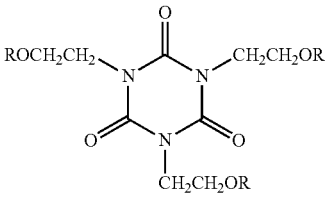

Provided that R represents an acryloyl group ($CH_2{=}CHCO{-}$) and R' represents a methacryloyl group ($CH_2{=}CCH_3CO{-}$) in the chemical formulas representing the exemplified compounds M1 to M15 described above.

The surface layer 1*e* may contain lubricant particles and various kinds of antioxidants if necessary in addition to the binder resin for surface layer, the n-type metal oxide fine particles, and the electron transport agent as described above.

[Lubricant Particles]

Examples of the lubricant particles may include fluorine atom-containing resin particles. Examples of the fluorine atom-containing resin particles may include a tetrafluoroethylene resin, a trifluorochloroethylene resin, a hexafluorochloroethylene-propylene resin, a vinyl fluoride resin, a vinylidene fluoride resin, and a difluorodichloroethylene resin, and any copolymer of these can also be used. These may be used singly or in combination of two or more kinds thereof. Among these, it is particularly preferable to use a tetrafluoroethylene resin and a vinylidene fluoride resin.

The layer thickness of the surface layer 1*e* is preferably in a range of from 0.1 to 15.0 μm, more preferably in a range of from 1 to 10 μm, and particularly preferably in a range of from 3 to 5 μm.

In a case in which the layer thickness of the surface layer 1*e* is too thick, it is concerned that a problem that the so-called film thickness unevenness that the film thickness is not uniform in the longitudinal direction or circumferential direction of the photoreceptor is likely to occur and thus the image to be obtained have image defects or the sharpness of the image to be obtained deteriorates is caused. In addition, it is also concerned that the holes (positive holes) from the charge generating layer cannot cancel the electrons at the right over position but cancel the electrons at the position slightly shifted from the right over position, the image to be obtained is blurred, or thin line reproducibility decreases in some cases. Meanwhile, in a case in which the layer thickness of the surface layer 1*e* is too thin, it is concerned that the lifespan of the photoreceptor is shortened or wear resistance decreases.

The universal hardness (HU) of the surface layer 1*e* may be 150 $N/mm^2$ or more, and it is preferably 200 $N/mm^2$ or more and 350 $N/mm^2$ or less from the viewpoint of improving the wear resistance.

The photoreceptor obtains appropriate wear resistance as the universal hardness of the surface layer 1*e* is in the above range.

In the embodiment of the present invention, the universal hardness of the surface layer 1*e* is a value measured by the "FISCHERSCOPE HM2000S" (manufactured by Fisher Technology, Inc.).

Specifically, the universal hardness is determined by the following Equation (HU) from the indentation depth h and the load F when the surface of the photoreceptor is pushed by applying a load F to the Vickers indenter of a diamond quadrangular pyramid under a test load by the "FISCHERSCOPE HM2000S".

Equation (*HU*): $HU \text{ (universal hardness)} = F/(26.45 \times h^2)$

Incidentally, the universal hardness of the surface layer 1*e* can be controlled by the conditions (radiation time and kind of active ray) for the curing treatment and the kind of polymerizable compound at the time of forming the surface layer 1*e*.

[Formation of Surface Layer]

The surface layer 1*e* can be fabricated by coating a coating liquid prepared by adding to a solvent the polyfunctional radically polymerizable compound, the specific n-type metal oxide fine particles 1*e*A, and the electron transport agent, and, if necessary, a resin, a polymerization initiator, lubricant particles, an antioxidant, and the like which are known on the surface of the charge transport layer 1*d* by a known method to form a coating film and subjecting the coating film to a curing treatment.

[Polymerization Initiator]

As a method for polymerization reaction of the polyfunctional radically polymerizable compound, it is possible to employ a method utilizing an electron beam cleavage reaction, a method utilizing light or heat in the presence of a radical polymerization initiator, or the like.

Examples of the radical polymerization initiator for initiating the polymerization reaction of the polyfunctional radically polymerizable compound may include a thermal polymerization initiator and a photopolymerization initiator, and these can also be used concurrently.

Examples of the thermal polymerization initiator may include an azo compound such as 2,2'-azobisisobutyronitrile, 2,2'-azobis(2,4-dimethylazobisvaleronitrile), or 2,2'-azobis(2-methylbutyronitrile); and a peroxide such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, or lauroyl peroxide.

Examples of the photopolymerization initiator may include an acetophenone-based or ketal-based photopolymerization initiator such as diethoxyacetophenone, 2,2-dimethoxy-1,2-diphenylethan-1-one, 1-hydroxy-cyclohexylphenylketone, 4-(2-hydroxyethoxy)phenyl-(2-hydroxy-2-propyl) ketone, 2-benzyl-2-dimethylamino-1-(4-morpholinophenyl) butanone-1 ("Irgacure 369" (manufactured by BASF SE)), 2-hydroxy-2-methyl-1-phenylpropane-1-one, 2-methyl-2-morpholino(4-methylthiophenyl)propane-1-one, or 1-phenyl-1,2-propanedione-2-(o-ethoxycarbonyl) oxime; a benzoin ether-based photopolymerization initiator such as benzoin, benzoin methyl ether, benzoin ethyl ether, benzoin isobutyl ether, or benzoin isopropyl ether; a benzophenone-based photopolymerization initiator such as benzophenone, 4-hydroxybenzophenone, methyl o-benzoylbenzoate, 2-benzoylnaphthalene, 4-benzoylbiphenyl, 4-benzoylphenyl ether, acrylated benzophenone, or 1,4-benzoylbenzene; and a thioxanthone-based photopolymerization initiator such as 2-isopropylthioxanthone, 2-chlorothioxanthone, 2,4-dimethylthioxanthone, 2,4-diethylthioxanthone, or 2,4-dichlorothioxanthone.

Examples of other photopolymerization initiators may include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide ("Irgacure 819" (manufactured by BASF SE)), bis(2,4-dimethoxybenzoyl)-2,4,4-trimethylpentylphosphine oxide, methylphenylglyoxy ester, 9,10-phenanthrene, an acridine-based compound, a triazine-based compound, and an imidazole-based compound. In addition, it is also possible to use those having a photopolymerization accelerating effect singly or concurrently with the photopolymerization initiators described above. Examples of those having a photopolymerization accelerating effect may include triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone.

As the polymerization initiator, it is preferable to use a photopolymerization initiator, it is more preferable to use an alkylphenone-based compound, and a phosphine oxide-based compound, and it is even more preferable to use a photopolymerization initiator having an α-hydroxyacetophenone structure or an acylphosphine oxide structure.

These polymerization initiators may be used singly or as a mixture of two or more kinds thereof.

The proportion of the polymerization initiator used is from 0.1 to 40 parts by mass and preferably from 0.5 to 20 parts by mass with respect to 100 parts by mass of the polyfunctional radically polymerizable compound.

[Solvent]

Examples of the solvent to be used in the formation of the surface layer 1*e* may include methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine, but the solvent is not limited thereto.

These may be used singly or as a mixture of two or more kinds thereof.

In the curing treatment, it is preferable that the polyfunctional radically polymerizable compound is polymerized by irradiating the coating film with an active ray to generate a radical and cured by forming a crosslinking bond between the molecules and in the molecules through a crosslinking reaction to produce a binder resin for surface layer. As the active ray, it is preferable to use light such as ultraviolet light or visible light or an electron beam, and it is particularly preferable to utilize ultraviolet light from the viewpoint of ease of use.

As alight source of ultraviolet light, for example, it is possible to use a low pressure mercury lamp, a medium pressure mercury lamp, a high pressure mercury lamp, an ultrahigh pressure mercury lamp, a carbon arc lamp, a metal halide lamp, a xenon lamp, flash (pulse) xenon, and ultraviolet LED. The radiation conditions vary depending on the lamp, but the radiation dose of the active ray is usually from 1 to 20 mJ/cm$^2$ and preferably from 5 to 15 mJ/cm$^2$. The output voltage of the light source is preferably from 0.1 to 5 kW and particularly preferably from 0.5 to 3 kW.

As the electron beam source, for example, a curtain beam type electron beam radiation apparatus can be preferably used. The accelerating voltage at the time of radiation of an electron beam is preferably from 100 to 300 kV. The absorbed radiation dose is preferably from 0.005 Gy to 100 kGy (0.5 to 10 Mrad).

The radiation time of active ray may be any time as long as the required radiation dose of the active ray is obtained, and specifically, it is preferably from 0.1 second to 10 minutes, and it is more preferably from 1 second to 5 minutes from the viewpoint of curing efficiency or work efficiency.

The coating film may be subjected to a drying treatment before and after being irradiated with the active ray and while being irradiated with the active ray. The timing to conduct the drying treatment can be appropriately selected in combination with the radiation conditions of the active ray. In addition, the drying conditions for the surface layer 1*e* can be appropriately selected depending on the kind of solvent to be used in the coating liquid, the film thickness of the surface layer 1*e*, and the like. In addition, the drying temperature is preferably from room temperature to 180° C. and particularly preferably from 80 to 140° C. The drying time is preferably from 1 to 200 minutes and particularly preferably from 5 to 100 minutes. By drying the coating film under such drying conditions, it is possible to control the amount of solvent contained in the surface layer 1*e* to be in a range of from 20 ppm to 75 ppm.

Hereinafter, the configuration of the photoreceptor other than the surface layer 1*e* will be described.

[Conductive Support 1*a*]

The conductive support 1*a* may be any one that exhibits conductivity, and examples thereof may include those fabricated by molding metals such as aluminum, copper, chromium, nickel, zinc, and stainless steel into a drum or sheet shape, those fabricated by laminating a metal foil such as an aluminum foil or a copper foil on a plastic film, those fabricated by depositing aluminum, indium oxide, tin oxide, or the like on a plastic film, and a metal, a plastic film, paper, and the like provided with a conductive layer by coating a conductive material singly or together with a binder resin.

[Intermediate Layer 1*b*]

The intermediate layer 1*b* imparts a barrier function and an adhesive function between the conductive support 1*a* and the photosensitive layer if. It is preferable to provide such an intermediate layer 1*b* from the viewpoint of preventing various faults and the like.

Such an intermediate layer 1*b* contains, for example, a binder resin (hereinafter, also referred to as the "binder resin for intermediate layer") and, if necessary, conductive particles or metal oxide particles.

Examples of the binder resin for intermediate layer may include casein, polyvinyl alcohol, nitrocellulose, an ethylene-acrylic acid copolymer, a polyamide resin, a polyurethane resin, and gelatin. Among these, a polyamide resin soluble an alcohol is preferable.

It is possible to contain various kinds of conductive particles or metal oxide particles in the intermediate layer 1*b* for the purpose of adjusting the electric resistance. For example, it is possible to use particles of various kinds of metal oxides such as alumina, zinc oxide, titanium oxide, tin oxide, antimony oxide, indium oxide, and bismuth oxide. It is possible to use ultrafine particles of indium oxide doped with tin, tin oxide and zirconium oxide doped with antimony, and the like.

The number average primary particle diameter of such metal oxide particles is preferably 0.3 μm or less and more preferably 0.1 μm or less.

The metal oxide particles may be used singly or as a mixture of two or more kinds thereof. The metal oxide particles may be in the form of a solid solution or fusion bonding in the case of mixing two or more kinds thereof.

The proportion of the conductive particles or metal oxide particles contained is preferably from 20 to 400 parts by mass and more preferably from 50 to 200 parts by mass with respect to 100 parts by mass of the binder resin for intermediate layer.

The intermediate layer 1*b* as described above can be formed, for example, by dissolving the binder resin for intermediate layer in a known solvent, if necessary, dispersing conductive particles or metal oxide particles in the solution to prepare a coating liquid for forming an intermediate layer, coating this coating liquid for forming an intermediate layer on the surface of the conductive support 1*a* to form a coating film, and drying this coating film.

The concentration of the binder resin for intermediate layer in the coating liquid for forming an intermediate layer can be appropriately selected depending on the layer thickness of the intermediate layer 1*b* and the coating method.

The solvent to be used in the formation of the intermediate layer 1*b* is not particularly limited and various known organic solvents can be used, but it is preferable to use an alcohol having from 2 to 4 carbon atoms such as ethanol, n-propyl alcohol, isopropyl alcohol, n-butanol, t-butanol, or sec-butanol since it enables the polyamide resin which is regarded to be preferred as the binder resin for intermediate layer to exhibit favorable solubility and coating performance. In addition, it is possible to concurrently use a co-solvent with the solvent described above in order to improve the storage stability and the dispersibility of conductive particles or metal oxide particles. Preferred examples of the co-solvent may include methanol, benzyl alcohol, toluene, cyclohexanone, and tetrahydrofuran. These solvents and co-solvents may be used singly or as a mixture of two or more kinds thereof, respectively.

As a unit for dispersing the conductive particles or metal oxide particles, it is possible to use an ultrasonic disperser, a ball mill, a sand grinder, and a homomixer.

The method for coating the coating liquid for forming an intermediate layer is not particularly limited, but examples thereof may include a dip coating method, a spray coating method, a spinner coating method, a bead coating method, a blade coating method, a beam coating method, and a circular amount regulating coating method (circular slide hopper coating method).

As a method for drying the coating film, a known drying method can be appropriately selected depending on the kind of the solvent and the film thickness of the intermediate layer 1*b* to be formed, and thermal dry is particularly preferable.

The layer thickness of the intermediate layer 1*b* is preferably from 0.1 to 15 μm and more preferably from 0.3 to 10 μm.

[Charge Generating Layer 1*c*]

The charge generating layer 1*c* contains a charge generating material and a binder resin (hereinafter, also referred to as the "binder resin for charge generating layer").

Examples of the charge generating material may include an azo raw material such as Sudan Red and Diane Blue, a quinone pigment such as pyrenequinone or anthanthrone, a quinocyanine pigment, a perylene pigment, an indigo pigment such as indigo or thioindigo, a polycyclic quinone pigment such as pyranthrone or diphthaloyl pyrene, and a phthalocyanine pigment, but the charge generating material is not limited thereto. Among these, a polycyclic quinone pigment and a titanyl phthalocyanine pigment are preferable. These charge generating materials may be used singly or as a mixture of two or more kinds thereof.

As the binder resin for charge generating layer, a known resin can be used, and examples thereof may include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymer resin containing two or more of these resins (for example, a vinyl chloride-vinyl acetate copolymer resin and a vinyl chloride-vinyl acetate-maleic anhydride copolymer resin), and a polyvinyl carbazole resin, but the binder resin for charge generating layer is not limited thereto. Among these, a polyvinyl butyral resin is preferable.

The mixing proportion of the charge generating material to the binder resin for charge generating layer is preferably from 1 to 600 parts by mass and more preferably from 50 to 500 parts by mass with respect to 100 parts by mass of the binder resin for charge generating layer. As the mixing proportion of the charge generating material to the binder resin for charge generating layer is in the above range, the coating liquid for forming a charge generating layer to be described later obtains high dispersion stability and also the electric resistance of the photoreceptor formed is suppressed low so that an increase in residual potential due to repeated use can be extremely suppressed.

The charge generating layer 1*c* as described above can be formed, for example, by adding and dispersing a charge generating material in a binder resin for charge generating layer dissolved in a known solvent to prepare a coating liquid for forming a charge generating layer, coating this coating liquid for forming a charge generating layer on the surface of the intermediate layer 1*b* to form a coating film, and drying this coating film.

As the solvent to be used in the formation of the charge generating layer 1*c*, a solvent capable of dissolving the binder resin for charge generating layer may be used, and examples thereof may include a ketone-based solvent such as methyl ethyl ketone or cyclohexanone, an ether-based solvent such as tetrahydrofuran, 1-dioxane, or 1,3-dioxolane, an alcohol-based solvent such as methyl cellosolve, ethyl cellosolve, methanol, ethanol, propanol, or butanol, an ester-based solvent such as ethyl acetate or t-butyl acetate, and an aromatic solvent such as toluene or xylene, but the solvent is not limited thereto. These may be used singly or as a mixture of two or more kinds thereof.

Examples of the method for dispersing the charge generating material may include the same method as the method for dispersing the conductive particles or metal oxide particles in the coating liquid for forming an intermediate layer.

In addition, examples of the method for coating the coating liquid for forming a charge generating layer may include the same method as the method mentioned as the method for coating the coating liquid for forming an intermediate layer.

The layer thickness of the charge generating layer 1*c* varies depending on the properties of the charge generating material, the properties and contained proportion of the binder resin for charge generating layer, and the like, but it is preferably from 0.01 to 5 μm and more preferably from 0.05 to 3 μm.

[Charge Transport Layer 1*d*]

The charge transport layer 1*d* contains a charge transport material and a binder resin (hereinafter, also referred to as the "binder resin for charge transport layer").

Examples of the charge transport material of the charge transport layer 1*d* may include a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzimidazole derivative, a quinazoline derivative, a benzofuran derivative, an acridine derivative, a phenazine derivative, an aminostilbene derivative, a triarylamine derivative, a phenylenediamine derivative, a stilbene derivative, a benzidine derivative, poly-N-vinylcarbazole, poly-1-vinylpyrene, and poly-9-vinylanthracene as a material which transports a charge. These may be used singly or as a mixture of two or more kinds thereof.

As the binder resin for charge transport layer, a known resin can be used, and examples thereof may include a polycarbonate resin, a polyacrylate resin, a polyester resin, a polystyrene resin, a styrene-acrylonitrile copolymer resin, a polymethacrylic ester resin, and a styrene-methacrylic ester copolymer resin, but a polycarbonate resin is preferable. Furthermore, a polycarbonate resin of a BPA (bisphenol A) type, a BPZ (bisphenol Z) type, a dimethyl BPA type, or a BPA-dimethyl BPA copolymer type and the like are preferable from the viewpoint of crack resistance, wear resistance, and charging property.

The proportion of the charge transport material contained in the charge transport layer 1*d* is preferably from 10 to 500 parts by mass and more preferably from 20 to 100 parts by mass with respect to 100 parts by mass of the binder resin for charge transport layer.

An antioxidant, an electron conducting agent, a stabilizer, silicone oil, and the like may be added to the charge transport layer 1*d*. Those disclosed in JP 2000-305291 A are preferable as the antioxidant, and those disclosed in JP 50-137543 A and JP 58-76483 A are preferable as the electronic conducting agent.

The layer thickness of the charge transport layer 1*d* varies depending on the properties of the charge transport material, the properties and contained proportion of the binder resin for charge transport layer, and the like, but it is preferably from 5 to 40 μm and more preferably from 10 to 30 μm.

The charge transport layer 1*d* as described above can be formed, for example, by adding and dispersing a charge transport material (CTM) in a binder resin for charge transport layer dissolved in a known solvent to prepare a coating liquid for forming a charge transport layer, coating this coating liquid for forming a charge transport layer on the surface of the charge generating layer 1*c* to form a coating film, and drying this coating film.

Examples of the solvent to be used in the formation of the charge transport layer 1*d* may include the same one as the solvent to be used in the formation of the charge generating layer 1*c*.

In addition, examples of the method for coating the coating liquid for forming a charge transport layer may include the same method as the method mentioned as the method for coating the coating liquid for forming a charge generating layer.

[Image Forming Apparatus]

The image forming apparatus according to the embodiment of the present invention includes the photoreceptor described above.

Specifically, the image forming apparatus includes, for example, a charging unit for negatively charging the surface of the photoreceptor, an exposure unit for exposing the photoreceptor charged by the charging unit to form an electrostatic latent image, a developing unit for supplying toner to the photoreceptor and developing the electrostatic latent image with the toner to form a toner image, a transfer unit for transferring the toner image formed on the photoreceptor, and a cleaning unit for removing the toner remaining on the surface of the photoreceptor.

Figure 2:
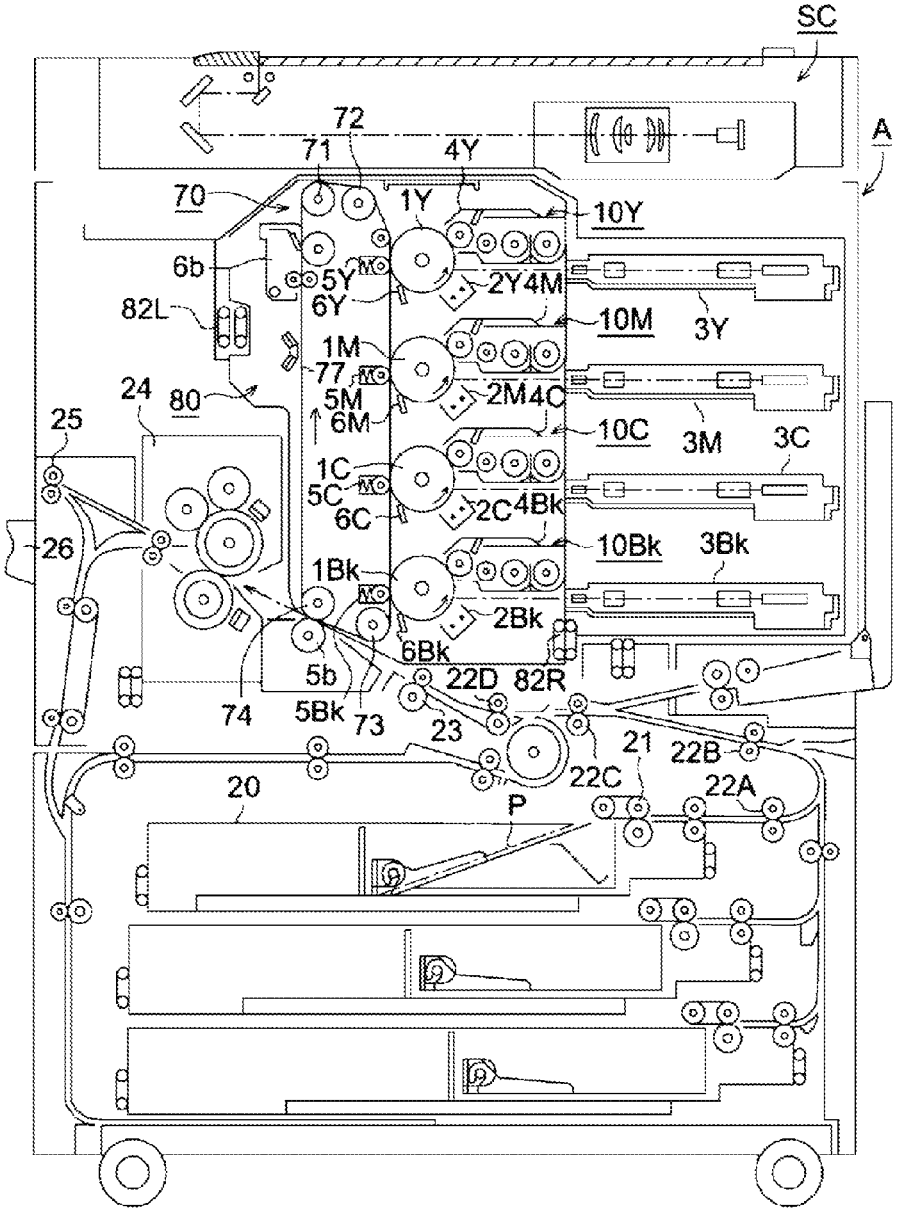
FIG. 2 is an explanatory cross-sectional diagram illustrating the configuration of an example of an image forming apparatus according to an embodiment of the present invention.

FIG. 2 is an explanatory cross-sectional diagram illustrating the configuration of an example of the image forming apparatus according to the embodiment of the present invention.

This image forming apparatus is called a tandem type color image forming apparatus, and it is configured by four image forming sections (image forming units) 10Y, 10M, 10C, and 10Bk, an intermediate transfer body unit 70, a paper feeding unit 21, and a fixing unit 24. An original image reading device SC is disposed at the upper part of the main body A of the image forming apparatus.

The four image forming units 10Y, 10M, 10C, and 10Bk are constituted by photoreceptors 1Y, 1M, 1C, and 1Bk positioned in the center, charging units 2Y, 2M, 2C, and 2Bk, exposure units 3Y, 3M, 3C, and 3Bk, rotating developing units 4Y, 4M, 4C, and 4Bk, primary transfer rollers 5Y, 5M, 5C, and 5Bk, and cleaning units 6Y, 6M, 6C, and 6Bk for cleaning the photoreceptors 1Y, 1M, 1C, and 1Bk.

The image forming apparatus according to the embodiment of the present invention uses the photoreceptor according to the embodiment of the present invention as the photoreceptors 1Y, 1M, 1C, and 1Bk, respectively.

The image forming units 10Y, 10M, 10C, and 10Bk have the same configuration except that the colors of the toner images formed on the photoreceptors 1Y, 1M, 1C, and 1Bk are different to be yellow, magenta, cyan, and black, respectively, and the image forming unit 10Y will be described in detail as an example.

In the image forming unit 10Y, a charging unit 2Y, an exposure unit 3Y, a developing unit 4Y, and a cleaning unit 6Y are disposed around a photoreceptor 1Y that is an image forming body, and a yellow (Y) toner image is formed on the photoreceptor 1Y.

The charging unit 2Y is a unit for uniformly and negatively charging the surface of the photoreceptor 1Y. As the charging unit 2Y, for example, a corona discharge type charging device is used.

The exposure unit 3Y is a unit for forming an electrostatic latent image corresponding to the yellow image on the photoreceptor 1Y to which a uniform potential is applied by the charging unit 2Y by performing exposure based on the image signal (yellow), and as this exposure unit 3Y, one constituted by an LED in which light emitting elements are arranged in an array shape in the axial direction of the photoreceptor 1Y and an imaging element, a laser optical system, or the like is used.

The developing unit 4Y is constituted, for example, by a developing sleeve which has a magnet built-in, holds a developer, and rotates and a voltage applying device for applying a direct current and/or an alternating bias voltage between the photoreceptor and this developing sleeve.

The cleaning unit 6Y is a unit for removing the toner remaining on the surface of the photoreceptor 1Y. The cleaning unit 6Y of this example is constituted by a cleaning blade and a brush roller provided on the upstream side of the cleaning blade.

In the image forming apparatus illustrated in FIG. 2, the photoreceptor 1Y, the charging unit 2Y, the developing unit 4Y, and the cleaning unit 6Y in the image forming unit 10Y are integrally supported and equipped as a process cartridge, and this process cartridge may be configured to be detachable from the main body A of the image forming apparatus via a guide unit such as a rail.

The image forming units 10Y, 10M, 10C, and 10Bk are vertically arranged in tandem, and the intermediate transfer body unit 70 is disposed on the left side of the photoreceptors 1Y, 1M, 1C, and 1Bk in the drawing. A plurality of rollers 71, 72, 73, 74 are wound onto the intermediate transfer body unit 70, and the intermediate transfer body unit 70 is constituted by a semiconductive endless belt-shaped intermediate transfer body 77 that is rotatably supported, a secondary transfer roller 5*b* as a secondary transfer unit, and a cleaning unit 6*b*.

The image forming units 10Y, 10M, 10C, and 10Bk and the intermediate transfer body unit 70 are accommodated in a housing 80, and the housing 80 is configured to be capable of being drawn from the main body A of the image forming apparatus via support rails 82L and 82R.

Examples of the fixing unit 24 may include those of a heat roller fixing type that are constituted by a heating roller having a heating source in the interior and a pressure roller provided in a pressure welded state so as to forma fixing nip portion on this heating roller.

Incidentally, the image forming apparatus according to the embodiment of the present invention is illustrated as a color laser printer in FIG. 2, but it may be configured as a monochrome laser printer or a copier. In addition, in the image forming apparatus according to the embodiment of the present invention, a light source other than a laser, for example, an LED light source can be used as the exposure light source.

[Image Forming Method]

The image forming method according to the embodiment of the present invention is a method using a charging system which negatively charges the photoreceptor according to the embodiment of the present invention described above.

In the image forming method according to the embodiment of the present invention, specifically, image formation is conducted as follows by using the image forming apparatus as described above. In other words, first, the surfaces of the photoreceptors 1Y, 1M, 1C, and 1Bk are discharged to be negatively charged by the charging units 2Y, 2M, 2C, and 2Bk (charging step). Subsequently, the surfaces of the photoreceptors 1Y, 1M, 1C, and 1Bk are exposed on the basis of the image signals by the exposure units 3Y, 3M, 3C, and 3Bk to form an electrostatic latent image (exposure step). Subsequently, the toner is applied to the surfaces of the photoreceptors 1Y, 1M, 1C, and 1Bk and the electrostatic latent image is developed by the developing units 4Y, 4M, 4C, and 4Bk to form a toner image (developing step).

Subsequently, the primary transfer rollers 5Y, 5M, 5C, and 5Bk are brought into contact with the rotating intermediate transfer body 77. By this, the toner images of the respective colors formed on the photoreceptors 1Y, 1M, 1C, and 1Bk are successively transferred onto the rotating intermediate transfer body 77 to form a color toner image (primary transfer step). During the image forming process, the primary transfer roller 5Bk is always in contact with the photoreceptor 1Bk. Meanwhile, the other primary transfer rollers 5Y, 5M, and 5C are in contact with the corresponding photoreceptors 1Y, 1M, and 1C only when a color image is formed.

Thereafter, the primary transfer rollers 5Y, 5M, 5C, and 5Bk and the intermediate transfer body 77 are separated from each other, and the toner remaining on the surfaces of the photoreceptors 1Y, 1M, 1C, and 1Bk are then removed by the cleaning units 6Y, 6M, 6C, and 6Bk (cleaning step). Thereafter, in preparation for the next image forming process, the surfaces of the photoreceptors 1Y, 1M, 1C, and 1Bk are neutralized by a charge removing unit (not illustrated) if necessary. At this time, the negative charges remaining on the surfaces of the photoreceptors 1Y, 1M, 1C, and 1Bk are easily moved to the charge transport layer 1*d* side by the electron transport agent and the specific n-type metal oxide fine particles 1*e*A, and the negative charges on the surfaces of the photoreceptors 1Y, 1M, 1C, and 1Bk are canceled by quickly bonding with the holes generated in the charge generating layer 1*c*.

Meanwhile, a transfer material P (for example, a support for carrying the final image such as plain paper, or a transparent sheet) stored in a paper feeding cassette 20 is fed by the paper feeding unit 21 and conveyed to the secondary transfer roller 5*b* as a secondary transfer unit via a plurality of intermediate rollers 22A, 22B, 22C, and 22D and a registration roller 23, and color toner images are collectively transferred onto the transfer material P as the secondary transfer roller 5*b* is brought into contact with the intermediate transfer body 77. The transfer material P to which the color toner image has been transferred is subjected to the fixing treatment by the fixing unit 24, nipped by a discharge roller 25, and placed on a discharge tray 26 at the outside of the apparatus. The secondary transfer roller 5*b* is brought into contact with the intermediate transfer body 77 only when the secondary transfer is conducted.

After the color toner image is transferred onto the transfer material P by the secondary transfer roller 5*b*, the toner remaining on the intermediate transfer body 77 from which the transfer material P has been curvedly separated is removed by the cleaning unit 6*b*.

[Toner and Developer]

The toner to be used in the image forming apparatus according to the embodiment of the present invention is not particularly limited, but it is composed of toner particles containing a binder resin and a colorant, and the toner particles may contain another component such as a releasing agent if desired.

As the toner, it is possible to use either of a pulverized toner or a polymerized toner, but in the image forming apparatus according to the embodiment of the present invention, it is preferable to use a polymerized toner from the viewpoint of obtaining a high quality image.

The average particle diameter of the toner is preferably from 2 to 8 μm as a volume based median diameter. By setting the average particle diameter to be in this range, it is possible to increase the resolution.

In addition, it is possible to externally add inorganic fine particles such as silica and titania having an average particle diameter of about from 10 to 300 nm and an abrasive of about from 0.2 to 3 μm as an external additive to the toner particles in appropriate amounts.

The toner can also be used as a magnetic or nonmagnetic one-component developer, but it may be used as a two-component developer by being mixed with a carrier.

In the case of using the toner as a two-component developer, it is possible to use magnetic particles composed of a material known in the prior art such as a ferromagnetic metal such as iron, an alloy of a ferromagnetic metal with aluminum, lead, and the like, a compound of a ferromagnetic metal such as ferrite and magnetite as the carrier, and ferrite is particularly preferable.

The embodiments of the present invention have been specifically described above, but the embodiments of the present invention are not limited to the above examples, and various modifications can be made.

EXAMPLES

Specific Examples of the present invention will be described below, but the present invention is not limited thereto.

Fabrication Example 1 of n-Type Metal Oxide Fine Particles

In a wet sand mill (alumina beads having a diameter of 0.5 mm), 100 parts by mass of "tin oxide ($SnO_2$)" having a number average primary particle diameter of 20 nm, 30 parts by mass of 3-methacryloxypropyltrimethoxysilane "KBM-503" (manufactured by Shin-Etsu Chemical Co., Ltd.) as a surface treatment agent, and 1000 parts by mass of methyl ethyl ketone were put and mixed at 30° C. for 6 hours, thereafter, methyl ethyl ketone and alumina beads were separated from the mixture through filtration, and the residual was dried at 60° C., thereby fabricating n-type metal oxide fine particles [1].

Fabrication Examples 2 to 5 of n-Type Metal Oxide Fine Particles n-type metal oxide fine particles [2] to [5] were fabricated in the same manner as in Fabrication Example 1 of n-type metal oxide fine particles except that $TiO_2$, $In_2O_3$, indium tin oxide (ITO), and ZnO were used instead of tin oxide ($SnO_2$), respectively.

Fabrication Example 6 of n-Type Metal Oxide Fine Particles n-type metal oxide fine particles [6] were fabricated in the same manner as in Fabrication Example 1 of n-type metal oxide fine particles except that the "KBM-5103" was used instead of the "KBM-503" as the surface treatment agent.

Example 1: Fabrication Example 1 of Photoreceptor (1) Fabrication of Conductive Support The surface of a drum-shaped aluminum support (outer diameter: 80 mm) was subjected to cutting, thereby fabricating a conductive support [1].

(2) Formation of Intermediate Layer

Binder resin for intermediate layer: 100 parts by mass of a polyamide resin (N-1) represented by the following formula (N-1) was added to 1700 parts by mass of a mixed solvent of ethanol/n-propyl alcohol/tetrahydrofuran (volume ratio: 45/20/35) and they were stirred and mixed at 20° C. To this solution, 97 parts by mass of metal oxide fine particles [1] (one fabricated by treating the surface of rutile type titanium oxide "MT-500 SA" having a number average primary particle diameter of 35 nm (manufactured by TAYCA CORPORATION) with a surface treatment agent: 3-methacryloxypropyltrimethoxysilane "KBM-503" (manufactured by Shin-Etsu Chemical Co., Ltd.) and 226 parts by mass of metal oxide fine particles [2] (one fabricated by treating the surface of rutile type titanium oxide "MT-500SA" (manufactured by TAYCA CORPORATION) having a number average primary particle diameter of 35 nm with surface treatment agents: methylhydrogenpolysiloxane (MHPS): 1,1,1,3,5,5,5-heptamethyltrisiloxane (manufactured by Shin-Etsu Chemical Co., Ltd.)) were added and dispersed by using a bead mill by setting the retention time in the mill to 5 hours. Thereafter, this solution was allowed to stand still for a whole day and night and then filtered, thereby obtaining a coating liquid for forming an intermediate layer. The filtration was conducted under a pressure of 50 kPa using the Rigimesh filter (manufactured by Pall Corporation) having a nominal filtration accuracy of 5 μm as a filtration filter. The coating liquid for forming an intermediate layer thus obtained was coated on the outer circumferential surface of the cleaned conductive support [1] by a dip coating method and dried at 120° C. for 30 minutes, thereby forming an intermediate layer [1] having a dry film thickness of 2 μm.

[Chemical Formula 7]

Formula (N-1)

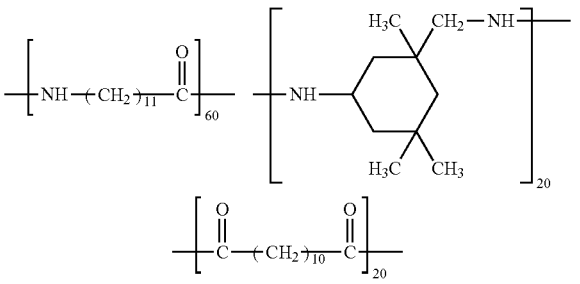

(3) Formation of Charge Generating Layer (3-1) Synthesis of Charge Generating Material Crude titanyl phthalocyanine was synthesized from 1,3-diiminoisoindoline and titanium tetra-n-butoxide, and a solution prepared by dissolving the crude titanyl phthalocyanine thus obtained in sulfuric acid was poured into water to precipitate a crystal. This solution was filtered, and the crystal thus obtained was then thoroughly washed with water to obtain a wet paste product. Subsequently, the wet paste product was frozen in a freezer, thawed again, then filtered, and dried, thereby obtaining amorphous titanyl phthalocyanine.

The amorphous titanyl phthalocyanine thus obtained and (2R,3R)-2,3-butanediol were mixed in o-dichlorobenzene (ODB) so that the equivalent ratio of (2R,3R)-2,3-butanediol to amorphous titanyl phthalocyanine was 0.6. The mixture thus obtained was heated and stirred at from 60 to 70° C. for 6 hours, and the solution thus obtained was allowed to stand still for the night, and methanol was then further added thereto to precipitate a crystal. This solution was filtered, the crystal thus obtained was washed with methanol, thereby obtaining a charge generating material [CG-1] composed of a pigment containing titanyl phthalocyanine of (2R,3R)-2,3-butanediol adduct.

The X-ray diffraction spectrum of the charge generating material [CG-1] was measured, and as a result, peaks were observed at 8.3°, 24.7°, 25.1°, and 26.5°. It is presumed that the charge generating material [CG-1] thus obtained is a mixture of a 1:1 adduct of titanyl phthalocyanine and (2R,3R)-2,3-butanediol and titanyl phthalocyanine (non-adduct).

(3-2) Formation of Charge Generating Layer

The following raw materials were mixed and dispersed for 0.5 hour at a circulation flow rate of 40 L/H by using the circulation type ultrasonic homogenizer "RUS-600TCVP" (manufactured by NISSEI Corporation, 19.5 kHz, 600 W) to prepare a coating liquid for forming a charge generating layer [1].

Charge generating material [CG-1] 24 parts by mass

Binder resin for charge generating layer: polyvinyl butyral resin "S-LEC BL-1" (manufactured by SEKISUI CHEMICAL CO., LTD.) 12 parts by mass Solvent: methyl ethyl ketone/cyclohexanone=4/1 (V/V) 400 parts by mass The coating liquid for forming a charge generating layer [1] was coated on the intermediate layer [1] by a dip coating method to form a coating film, and this coating film was dried, thereby forming a charge generating layer [1] having a layer thickness of 0.5 μm.

(4) Formation of Charge Transport Layer

The following raw materials were mixed and dissolved to prepare a coating liquid for forming a charge transport layer [1].

Charge transport material: 4,4'-dimethyl-4"-(β-phenylstyryl)triphenylamine 225 parts by mass Binder resin for charge transport layer: polycarbonate resin "Z 300" (manufactured by MITSUBISHI GAS CHEMICAL COMPANY, INC.) 300 parts by mass Antioxidant: "Irganox 1010" (manufactured by Novartis International AG) 6 parts by mass Solvent: tetrahydrofuran 1600 parts by mass Solvent: toluene 400 parts by mass Leveling agent: silicone oil "KF-54" (manufactured by Shin-Etsu Chemical Co., Ltd.) 1 part by mass The coating liquid for forming a charge transport layer [1] was coated on the charge generating layer [1] by a dip coating method to form a coating film, and this coating film was dried, thereby forming a charge transport layer [1] having a layer thickness of 20 μm.

(5) Formation of Surface Layer

A coating liquid composition composed of n-type metal oxide fine particles [1] 100 parts by mass, Electron transport agent: compound represented by formula (ETM101) described above 10 parts by mass, Polymerizable compound: trimethylolpropane trimethacrylate (manufactured by Sartomer Company) 100 parts by mass, Polymerization initiator: "Irgacure 819" (manufactured by BASF SE) 15 parts by mass, and Solvent: 2-butanol 500 parts by mass was mixed and stirred to be sufficiently dissolved and dispersed, thereby preparing a coating liquid for forming a surface layer [1].

This coating liquid for forming a surface layer [1] was coated on the charge transport layer [1] by using a circular slide hopper coater and then irradiated with ultraviolet light for 1 minute by using a xenon lamp, thereby forming a surface layer [1] having a dry film thickness of 2.0 μm, a photoreceptor [1] was thus fabricated.

Examples 2 to 15: Fabrication Examples 2 to 15 of Photoreceptor

Photoreceptors [2] to [15] were fabricated in the same manner as in Fabrication Example 1 of photoreceptor except that the kind of the electron transport agent was respectively changed as presented in Table 1 in the step of forming the surface layer.

Examples 16 and 17: Fabrication Examples 16 and 17 of Photoreceptor

Photoreceptors [16] and [17] were fabricated in the same manner as in Fabrication Example 9 of photoreceptor except that the kind of the n-type metal oxide fine particles was changed as presented in Table 1 in the step of forming the surface layer.

Examples 18 and 19: Fabrication Examples 18 and 19 of Photoreceptor

Photoreceptors [18] and [19] were fabricated in the same manner as in Fabrication Example 10 of photoreceptor except that the kind of the n-type metal oxide fine particles was changed as presented in Table 1 in the step of forming the surface layer.

Examples 20 and 21: Fabrication Examples 20 and 21 of Photoreceptor

Photoreceptors [20] and [21] were fabricated in the same manner as in Fabrication Example 11 of photoreceptor except that trimethylolpropane triacrylate was used as a polymerizable compound as well as the kind of the n-type metal oxide fine particles was changed as presented in Table 1 in the step of forming the surface layer.

Example 22: Fabrication Example 22 of Photoreceptor

A photoreceptor [22] was fabricated in the same manner as in Fabrication Example 1 of photoreceptor except that 5 parts by mass of the compound represented by the formula (ETM101) and 5 parts by mass of the compound represented by the formula (ETM103) were used instead of 10 parts by mass of the compound represented by the formula (ETM101) as the electron transport agent in the step of forming the surface layer.

Example 23: Fabrication Example 23 of Photoreceptor

A photoreceptor [23] was fabricated in the same manner as in Fabrication Example 1 of photoreceptor except that 75 parts by mass of the n-type metal oxide fine particles [1] and 25 parts by mass of the n-type metal oxide fine particles [5] were used instead of 100 parts by mass of the n-type metal oxide fine particles [1] in the step of forming the surface layer.

Comparative Example 1: Fabrication Example 24 of Photoreceptor

A photoreceptor [24] was fabricated in the same manner as in Fabrication Example 1 of photoreceptor except that an electron transport agent was not added in the step of forming the surface layer.

Comparative Example 2: Fabrication Example 25 of Photoreceptor

A photoreceptor [25] was fabricated in the same manner as in Fabrication Example 1 of photoreceptor except that n-type metal oxide fine particles were not added in the step of forming the surface layer.

Comparative Example 3: Fabrication Example 26 of Photoreceptor

A photoreceptor [26] was fabricated in the same manner as in Fabrication Example 1 of photoreceptor except that the step of forming the surface layer was carried out as follows.

(5) Formation of Surface Layer

A coating liquid composition composed of n-type metal oxide fine particles [7] composed of $Al_2O_3$ subjected only to hydrophobic treatment 100 parts by mass, Electron transport agent: compound represented by formula (ETM-A) described above 10 parts by mass, Binder resin for surface layer: polycarbonate resin "Z-300" (manufactured by TORAY INDUSTRIES, INC.) 100 parts by mass, and Solvent: 2-butanol 500 parts by mass was mixed and stirred to be sufficiently dissolved and dispersed, thereby preparing a coating liquid for forming a surface layer [2].

This coating liquid for forming a surface layer [2] was coated on the charge transport layer [1] by using a circular slide hopper coater and then dried at 120° C. for 70 minutes, thereby forming a surface layer [2] having a dry film thickness of 2.0 μm, a photoreceptor [26] was thus fabricated.

Comparative Example 4: Fabrication Example 27 of Photoreceptor

A photoreceptor [27] was fabricated in the same manner as in Fabrication Example 26 of photoreceptor except that the compound represented by the formula (ETM403) was used instead of the compound represented by the formula (ETM-A) as an electron transport agent in the step of forming the surface layer.

Comparative Example 5: Fabrication Example 28 of Photoreceptor

A photoreceptor [28] was fabricated in the same manner as in Fabrication Example 23 of photoreceptor except that an electron transport agent was not added in the step of forming the surface layer.

TABLE 1

| | Photoreceptor No. | Surface layer: Electron transport agent | n-type metal oxide fine particles: No. | Metal oxide | Surface treatment agent | Polymerizable monomer |
|---|---|---|---|---|---|---|
| Example 1 | [1] | Formula (ETM101) | [1] | $SnO_2$ | KBM-503 | M1 (methacryloyl) |
| Example 2 | [2] | Formula (ETM102) | [1] | $SnO_2$ | KBM-503 | M1 (methacryloyl) |
| Example 3 | [3] | Formula (ETM103) | [1] | $SnO_2$ | KBM-503 | M1 (methacryloyl) |
| Example 4 | [4] | Formula (ETM104) | [1] | $SnO_2$ | KBM-503 | M1 (methacryloyl) |
| Example 5 | [5] | Formula (ETM201) | [1] | $SnO_2$ | KBM-503 | M1 (methacryloyl) |
| Example 6 | [6] | Formula (ETM202) | [1] | $SnO_2$ | KBM-503 | M1 (methacryloyl) |
| Example 7 | [7] | Formula (ETM301) | [1] | $SnO_2$ | KBM-503 | M1 (methacryloyl) |
| Example 8 | [8] | Formula (ETM401) | [1] | $SnO_2$ | KBM-503 | M1 (methacryloyl) |
| Example 9 | [9] | Formula (ETM402) | [1] | $SnO_2$ | KBM-503 | M1 (methacryloyl) |
| Example 10 | [10] | Formula (ETM403) | [1] | $SnO_2$ | KBM-503 | M1 (methacryloyl) |
| Example 11 | [11] | Formula (ETM404) | [1] | $SnO_2$ | KBM-503 | M1 (methacryloyl) |
| Example 12 | [12] | Formula (ETM405) | [1] | $SnO_2$ | KBM-503 | M1 (methacryloyl) |
| Example 13 | [13] | Formula (ETM501) | [1] | $SnO_2$ | KBM-503 | M1 (methacryloyl) |
| Example 14 | [14] | Formula (ETM502) | [1] | $SnO_2$ | KBM-503 | M1 (methacryloyl) |
| Example 15 | [15] | Formula (ETM503) | [1] | $SnO_2$ | KBM-503 | M1 (methacryloyl) |
| Example 16 | [16] | Formula (ETM402) | [2] | $TiO_2$ | KBM-503 | M1 (methacryloyl) |
| Example 17 | [17] | Formula (ETM402) | [3] | $In_2O_3$ | KBM-503 | M1 (methacryloyl) |
| Example 18 | [18] | Formula (ETM403) | [4] | ITO | KBM-503 | M1 (methacryloyl) |
| Example 19 | [19] | Formula (ETM403) | [5] | ZnO | KBM-503 | M1 (methacryloyl) |
| Example 20 | [20] | Formula (ETM404) | [6] | $SnO_2$ | KBM-5103 | M1 (acryloyl) |
| Example 21 | [21] | Formula (ETM404) | [5] | ZnO | KBM-503 | M1 (acryloyl) |
| Example 22 | [22] | Formula (ETM101)<br>Formula (ETM103) | [1] | $SnO_2$ | KBM-503 | M1 (methacryloyl) |
| Example 23 | [23] | Formula (ETM101) | [1]<br>[5] | $SnO_2$<br>ZnO | KBM-503<br>KBM-503 | M1 (methacryloyl) |
| Comparative Example 1 | [24] | Nil | [1] | $SnO_2$ | KBM-503 | M1 (methacryloyl) |
| Comparative Example 2 | [25] | Formula (ETM101) | | | Nil | M1 (methacryloyl) |
| Comparative Example 3 | [26] | Formula (ETM-A) | ([7]) | $Al_2O_3$ | (Hydrophobization only) | (Polycarbonate) |
| Comparative Example 4 | [27] | Formula (ETM403) | ([7]) | $Al_2O_3$ | (Hydrophobization only) | (Polycarbonate) |
| Comparative Example 5 | [28] | Nil | [5]<br>[1] | ZnO<br>$SnO_2$ | KBM-503<br>KBM-503 | M1 (methacryloyl) |

The hardness (universal hardness) of the photoreceptors [1] to [29] described above was measured. In addition, the photoreceptors [1] to [29] were mounted on an evaluation machine fabricated by modifying the image forming apparatus "bizhub PRO C8000" (manufactured by Konica Minolta, Inc.) to have a printing speed of 120 sheets/min and evaluated, respectively.

(1) Evaluation of Hardness (Universal Hardness)

The surface hardness (universal hardness value) was measured by using the "FISCHERSCOPE HM2000S" (manufactured by Fisher Technology, Inc.). The measurement conditions were as follows: a load was applied to the surface of the photoreceptor at 2 mN for 10 seconds, and the photoreceptor was returned to the initial state at 2 mN for 10 seconds after a creep time for 5 seconds. The results are presented in Table 2. The photoreceptor does not have a problem in durability when the value of the film hardness is 150 $N/mm^2$ or more.

(2) Evaluation of ΔVi

First, double-sided continuous printing of a character image having an image area ratio of 6% was conducted by 1,000 sheets for each by transversely feeding A4 paper at a black position under a low temperature and low humidity environment of a temperature of 10° C. and a relative humidity of 20% RH. Next, the internal mounting pattern No. 53/Dot 1 (a representative exposure pattern formed in a dot shape exhibiting regularity) was continuously printed on the transfer material "POD gross coat" (A3 size, 100 $g/m^2$) (manufactured by OJI PAPER CO., LTD.) by 100 sheets at a density indicating value of 255. A difference ΔVi 1 between the potential after exposure of the first sheet among the 100 sheets and the potential after exposure of the 100th sheet was calculated. Subsequently, a durability test was conducted in which a character image having an image area ratio of 6% was continuously printed by 500,000 sheets by transversely feeding A4 paper under the same conditions without changing the environmental conditions, and the image of the internal mounting pattern No. 53/Dot 1 was then continuously printed by 100 sheets again. A difference ΔVi 2 between the potential after exposure of the first sheet among the 100 sheets and the potential after exposure of the 100th sheet was calculated. ΔVi was evaluated from ΔVi 1 and ΔVi 2 according to the following evaluation criteria. The results are presented in Table 2.

The potential after exposure was measured under an environment of a temperature of 10° C. and a relative humidity of 20% RH by using the "CYNTHIA 59" (manufactured by GEN-TECH, INC.). The fluctuation of surface potential was measured by repeating charging and exposure under the conditions of a grid voltage of −800 V and an exposure amount of 0.5 $\mu J/cm^2$ while rotating the photoreceptor at 130 rpm.

—Evaluation Criteria—

A: ΔVi is 20 V or less before and after durability test (ΔVi 1 and ΔVi 2) (pass)

B: ΔVi is 20 V or less before durability test (ΔVi 1) but ΔVi is greater than 20 V and 45 V or less after durability test (ΔVi 2) (pass)

C: ΔVi is greater than 20 V and less than 40 V before durability test (ΔVi 1) or ΔVi is 20 V or less before durability test (ΔVi 1) and ΔVi is greater than 45 V after durability test (ΔVi 2) (failure)

D: ΔVi is greater than 40 V before durability test (ΔVi 1) (failure)

(3) Evaluation of Image Memory

First, double-sided continuous printing of a character image having an image area ratio of 6% was conducted by 1,000 sheets for each by transversely feeding A4 paper under an environment of a temperature of 30° C. and a relative humidity of 80% RH (initial). Thereafter, double-sided continuous printing of the image under the same conditions was conducted by 500,000 sheets for each (after being aged). At the initial stage and after being aged, an image in which a solid black image and a solid white image were mixed was continuously printed by 10 sheets, a uniform halftone image was subsequently printed, respectively, and the generation of history, namely, the generation of memory of the solid black image and solid white image on this halftone image was visually observed and evaluated according to the following evaluation criteria. The results are presented in Table 2.

—Evaluation Criteria—

R5: Memory is not observed on halftone image (pass)

R4: Minor memory is slightly observed but in practically acceptable level (pass)

R3: Minor memory is observed but in practically acceptable level (pass)

R2: Clear memory is slightly observed and in practically problematic level (failure)

R1: Clear memory is observed (failure)

(4) Evaluation of Dot Reproducibility

First, double-sided continuous printing of a character image having an image area ratio of 6% was conducted by 1,000 sheets for each by transversely feeding A4 paper under an environment of a temperature of 30° C. and a relative humidity of 80% RH (initial). Thereafter, double-sided continuous printing of the image under the same conditions was conducted by 500,000 sheets for each (after being aged). At the initial stage and after being aged, the internal mounting pattern No. 53/Dot 1 (a representative exposure pattern formed in a dot shape exhibiting regularity) was printed on the A3/POD gross coat paper (100 g/m$^2$, manufactured by OJI PAPER CO., LTD.) at a density indicating value of 100, respectively, and the state of dot formation was observed by using a 100-fold magnifying glass and evaluated according to the following evaluation criteria. The results are presented in Table 2.

—Evaluation Criteria—

R5: Dot is normally formed (pass)

R4: Dot is a bit thinned but there is no problem in practical use (pass)

R3: Dot is thinned but there is no problem in practical use (pass)

R2: Dot is hardly formed and there is problem in practical use (failure)

R1: Dot is not formed and there is problem in practical use (failure)

(5) Evaluation of Fog

First, double-sided continuous printing of a character image having an image area ratio of 6% was conducted by 1,000 sheets for each by transversely feeding A4 paper under an environment of a temperature of 30° C. and a relative humidity of 80% RH (initial). Thereafter, double-sided continuous printing of the image under the same conditions was conducted by 500,000 sheets for each (after being aged). At the initial stage and after being aged, the transfer material "POD gross coat" (A3 size, 100 g/m$^2$) (manufactured by OJI PAPER CO., LTD.) on which an image was not formed was conveyed to a black position and a plain image (white solid image) was formed on the transfer material under the conditions of a grid voltage of −800 V and a developing bias of −650 V, respectively, and the presence or absence of fog on the transfer material thus obtained was visually observed. In the same manner, a yellow solid image was formed under the conditions of a grid voltage of −800 V and a developing bias of −650 V, and the presence or absence of fog on the transfer material thus obtained was visually observed. Thereafter, it was evaluated according to the following evaluation criteria. The results are presented in Table 2.

—Evaluation Criteria—

R5: Fog is not observed on both of white solid image and yellow solid image (pass)

R4: Fog is slightly observed on either of white solid image or yellow solid image when being enlarged but in practically acceptable level (pass)

R3: Fog is observed on both of white solid image and yellow solid image when being enlarged but in practically acceptable level (pass)

R2: Fog is slightly visually observed on either of white solid image or yellow solid image (failure)

R1: Fog is conspicuously observed on either of white solid image or yellow solid image (failure)

TABLE 2

| | | | | Evaluation results | | | | | |
|---|---|---|---|---|---|---|---|---|---|
| | | | | Dot reproducibility | | Image memory | | Fog | |
| | Photoreceptor No. | Hardness | Δ Vi | Initial (1,000 sheets) | After being aged (500,000 sheets) | Initial (1,000 sheets) | After being aged (500,000 sheets) | Initial (1,000 sheets) | After being aged (500,000 sheets) |
| Example 1 | [1] | 258 | A | R5 | R4 | R5 | R4 | R5 | R4 |
| Example 2 | [2] | 225 | A | R4 | R3 | R4 | R3 | R4 | R3 |
| Example 3 | [3] | 265 | B | R4 | R3 | R4 | R3 | R4 | R3 |
| Example 4 | [4] | 254 | A | R4 | R3 | R4 | R3 | R4 | R4 |
| Example 5 | [5] | 251 | B | R4 | R4 | R4 | R4 | R4 | R4 |
| Example 6 | [6] | 255 | A | R5 | R4 | R4 | R3 | R5 | R4 |
| Example 7 | [7] | 250 | B | R5 | R3 | R4 | R4 | R5 | R4 |
| Example 8 | [8] | 250 | B | R4 | R3 | R4 | R3 | R5 | R3 |

TABLE 2-continued

| | | Evaluation results | | | | | | | |
|---|---|---|---|---|---|---|---|---|---|
| | | | | Dot reproducibility | | Image memory | | Fog | |
| | Photoreceptor No. | Hardness | Δ Vi | Initial (1,000 sheets) | After being aged (500,000 sheets) | Initial (1,000 sheets) | After being aged (500,000 sheets) | Initial (1,000 sheets) | After being aged (500,000 sheets) |
| Example 9 | [9] | 235 | A | R4 | R4 | R4 | R4 | R4 | R4 |
| Example 10 | [10] | 225 | A | R4 | R3 | R4 | R3 | R4 | R3 |
| Example 11 | [11] | 232 | B | R5 | R3 | R5 | R3 | R5 | R3 |
| Example 12 | [12] | 243 | B | R3 | R3 | R3 | R3 | R3 | R3 |
| Example 13 | [13] | 228 | B | R4 | R3 | R4 | R3 | R4 | R3 |
| Example 14 | [14] | 241 | B | R4 | R3 | R4 | R3 | R5 | R4 |
| Example 15 | [15] | 248 | A | R4 | R4 | R4 | R3 | R4 | R4 |
| Example 16 | [16] | 232 | B | R4 | R4 | R5 | R4 | R4 | R3 |
| Example 17 | [17] | 248 | A | R4 | R4 | R4 | R3 | R4 | R4 |
| Example 18 | [18] | 221 | A | R5 | R4 | R5 | R3 | R4 | R4 |
| Example 19 | [19] | 233 | B | R4 | R4 | R5 | R4 | R5 | R4 |
| Example 20 | [20] | 247 | B | R4 | R3 | R5 | R3 | R4 | R4 |
| Example 21 | [21] | 221 | B | R4 | R3 | R5 | R3 | R4 | R4 |
| Example 22 | [22] | 218 | B | R4 | R4 | R5 | R4 | R4 | R3 |
| Example 23 | [23] | 249 | A | R4 | R4 | R5 | R4 | R4 | R3 |
| Comparative Example 1 | [24] | 265 | C | R3 | R1 | R3 | R2 | R2 | R1 |
| Comparative Example 2 | [25] | 195 | D | R1 | R1 | R1 | R1 | R3 | R2 |
| Comparative Example 3 | [26] | 152 | C | R2 | R1 | R1 | R1 | R1 | R1 |
| Comparative Example 4 | [27] | 122 | C | R2 | R1 | R1 | R1 | R1 | R1 |
| Comparative Example 5 | [28] | 233 | C | R2 | R1 | R3 | R1 | R2 | R1 |

Although the present invention has been described and illustrated in detail, it is clearly understood that the same is by way of illustrated and example only and is not to be taken by way of limitation, the scope of the present invention being interpreted by terms of the appended claims.

What is claimed is:

1. An electrophotographic photoreceptor comprising an intermediate layer, a photosensitive layer, and a surface layer laminated on a conductive support in this order, wherein the surface layer comprises:

an electron transport agent; and a cured polymer polymerized from a polymerizable monomer and n-type metal oxide fine particles having a reactive organic group, and the reactive organic group is bonded to the polymerizable monomer in the polymer.

2. The electrophotographic photoreceptor according to claim 1, wherein the n-type metal oxide fine particles include at least one selected from the group consisting of tin oxide, titanium oxide, zinc oxide, indium oxide, and indium tin oxide.

3. The electrophotographic photoreceptor according to claim 1, wherein a thickness of the surface layer is from 1 to 10 μm.

4. The electrophotographic photoreceptor according to claim 1, wherein the reactive organic group of the n-type metal oxide fine particles is a group having an unsaturated double bond.

5. The electrophotographic photoreceptor according to claim 1, wherein the polymerizable monomer has a group having an unsaturated double bond.

6. The electrophotographic photoreceptor according to claim 1, wherein the electron transport agent includes at least one selected from the group consisting of an oxadiazole derivative represented by general formula (1) or (2), a quinone derivative represented by general formula (3) or (4), a fluorene derivative represented by general formula (5), a tetracarboxylic acid diimide derivative represented by general formula (6), and silole derivatives represented by general formulas (7) to (9):

General formula (1)

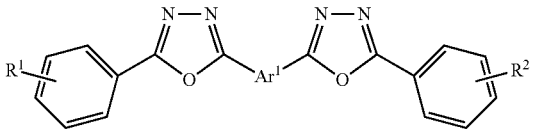

General formula (2)

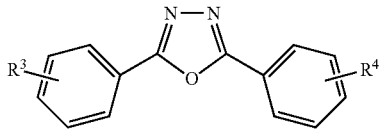

General formula (3)

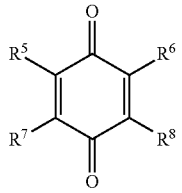

-continued

General formula (4)

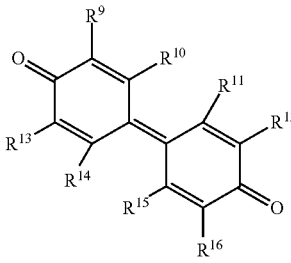

General formula (5)

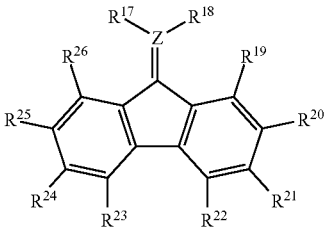

General formula (6)

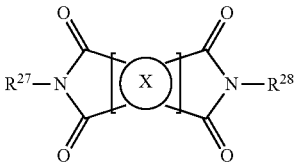

Formula (x1)

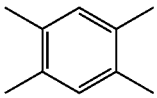

Formula (x2)

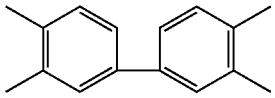

Formula (x3)

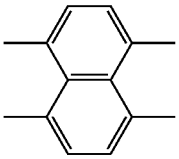

Formula (x4)

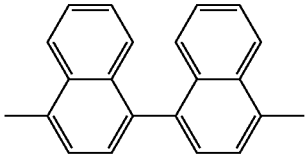

Formula (x5)

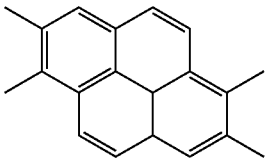

-continued

General formula (7)

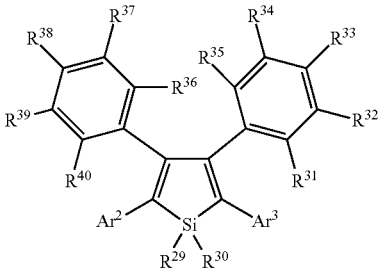

$Ar^2$, $Ar^3$ =

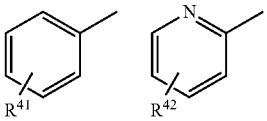

General formula (8)

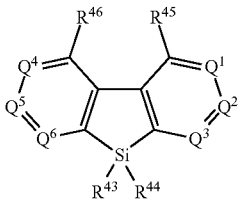

General formula (9)

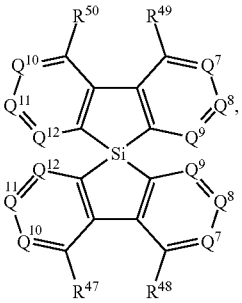

in the general formula (1), $R^1$ and $R^2$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —O(═O)—$R^a$ provided that $R^a$ is a monovalent organic group, and $Ar^1$ represents an arylene group which may have a substituent, in the general formula (2), $R^3$ and $R^4$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(═O)—$R^a$ provided that $R^a$ is a monovalent organic group, in the general formula (3), $R^5$ to $R^8$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ provided that $R^a$ is a monovalent organic group, in the general formula (4), $R^9$ to $R^{16}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ provided that $R^a$ is a monovalent organic group, in the general formula (5), $R^{17}$ and $R^{18}$ each independently represent a group selected from the group consisting of a hydrogen atom, a nitrile group, and an alkoxycarbonyl group which has from 1 to 8 carbon atoms and may have a substituent, at least either of them is a nitrile group or an alkoxycarbonyl group which has from 1 to 8 carbon atoms and may have a substituent, $R^{19}$ to $R^{26}$ each independently represent a group selected from the group consisting of a hydrogen atom, an alkyl group which has from 1 to 8 carbon atoms and may have a substituent, an aryl group which may have a substituent, and an alkoxycarbonyl group which has from 1 to 8 carbon atoms and may have a substituent, and Z represents a carbon atom or a nitrogen atom, in the general formula (6), $R^{27}$ and $R^{28}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, and a hydroxyl group, X is any of tetravalent groups represented by the formulas (x1) to (x5) and may have at least one substituent selected from the group consisting of an alkyl group which has from 1 to 8 carbon atoms and may have a substituent, an alkoxy group which has from 1 to 8 carbon atoms and may have a substituent, a halogen atom, an aryl group which has from 6 to 18 carbon atoms and may have a substituent, a cyano group, a nitro group, and a hydroxyl group, in the general formula (7), $R^{29}$ and $R^{30}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, an aryl group which has from 6 to 18 carbon atoms and may have a substituent, a cyano group, and a nitro group, these may be linked to each other to have a ring structure, $R^{31}$ to $R^{40}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and —C(=O)—$R^a$ (provided that $R^a$ is a monovalent organic group), and $R^{41}$ and $R^{42}$ each independently represent a group selected from the group consisting of a hydrogen atom, an alkyl group which has from 1 to 8 carbon atoms and may have a substituent, a cycloalkyl group which has from 3 to 12 carbon atoms and may have a substituent, an alkoxy group which has from 1 to 8 carbon atoms and may have a substituent, and a halogen atom, in the general formula (8), $R^{43}$ and $R^{44}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, an aryl group which has from 6 to 18 carbon atoms and may have a substituent, a cyano group, and a nitro group, these may be linked to each other to have a ring structure, $R^{45}$ and $R^{46}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and a heteroaryl group which may have a substituent, and $Q^1$ to $Q^6$ each independently represent a carbon atom or a nitrogen atom, and in the general formula (9), $R^{47}$ to $R^{50}$ each independently represent a group selected from the group consisting of a hydrogen atom, an alkyl group having from 1 to 8 carbon atoms, a cycloalkyl group which has from 3 to 12 carbon atoms and may have a substituent, an alkoxy group which has from 1 to 8 carbon atoms and may have a substituent, a halogen atom, an aryl group which may have a substituent, a cyano group, a nitro group, a hydroxyl group, and a heteroaryl group which may have a substituent, and $Q^7$ to $Q^{12}$ each independently represent, a carbon atom or a nitrogen atom.

7. The electrophotographic photoreceptor according to claim 6, wherein the oxadiazole derivative represented by the general formula (1) is a compound represented by Formula (ETM101) or (ETM102), the oxadiazole derivative represented by the general formula (2) is a compound represented by Formula (ETM103) or (ETM104), the quinone derivative represented by the general formula (3) is a compound represented by Formula (ETM201), the quinone derivative represented by the general formula (4) is a compound represented by Formula (ETM202), the fluorene derivative represented by the general formula (5) is a compound represented by Formula (ETM301), the tetracarboxylic acid diimide derivative represented by the general formula (6) is a compound represented by Formula (ETM401), (ETM402), (ETM403), (ETM404), or (ETM405), the silole derivative represented by the general formula (7) is a compound represented by Formula (ETM501), the silole derivative represented by the general formula (8) is a compound represented by Formula (ETM502), and the silole derivative represented by the general formula (9) is a compound represented by Formula (ETM503):

Formula (ETM101)
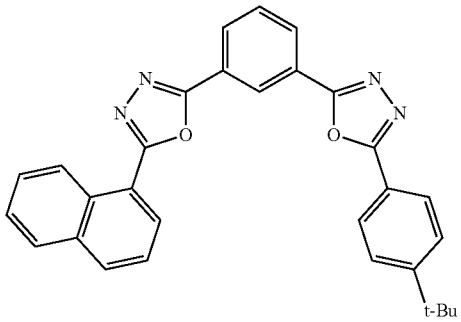
Formula (ETM102)
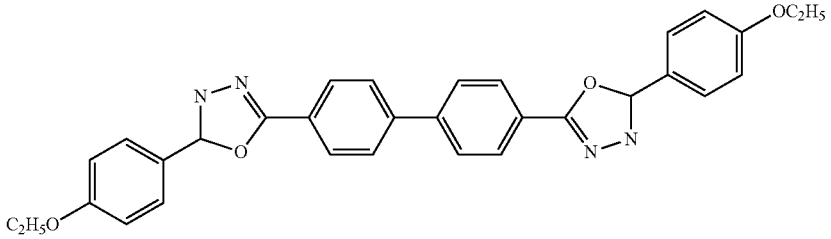
Formula (ETM103)
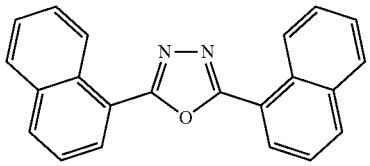
Formula (ETM104)
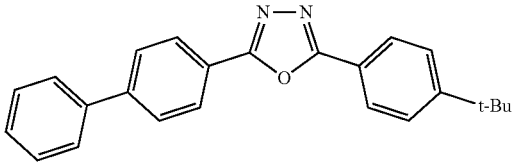
Formula (ETM201)
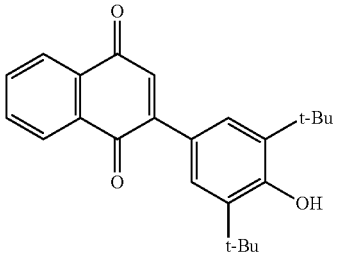
Formula (ETM202)
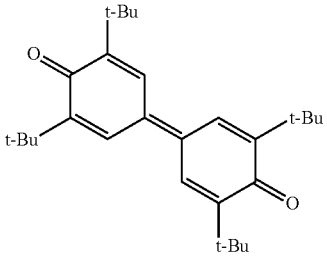
Formula (ETM301)
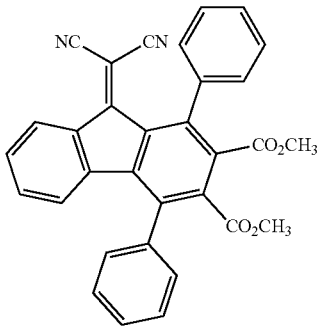
Formula (ETM401)
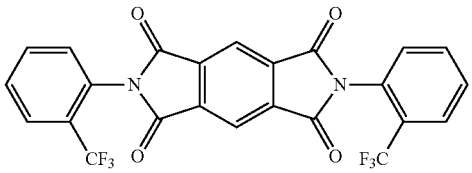
Formula (ETM402)
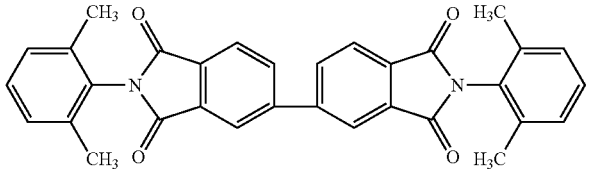
Formula (ETM403)
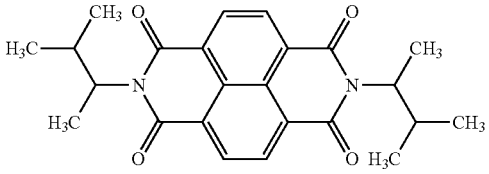

-continued

Formula (ETM404)

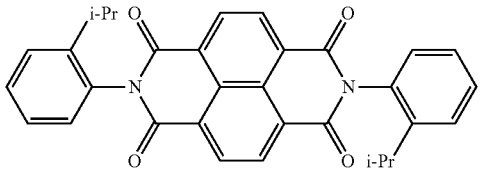

Formula (ETM405)

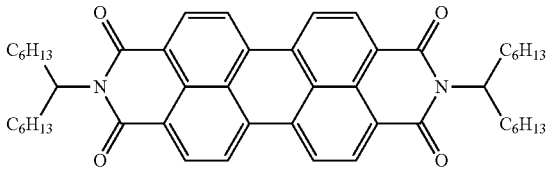

Formula (ETM501)

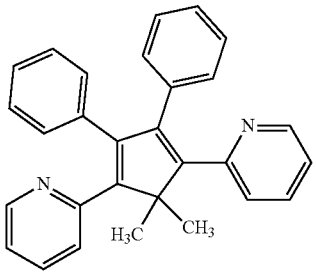

Formula (ETM502)

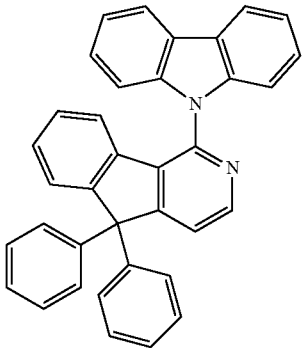

Formula (ETM503)

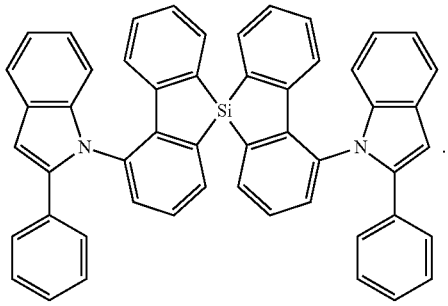

8. An image forming method comprising negatively charging the electrophotographic photoreceptor according to claim 1.

9. An image forming apparatus comprising the electrophotographic photoreceptor according to claim 1.

10. The electrophotographic photoreceptor according to claim 1, wherein the electron transport agent has no group reacting with the polymerizable monomer and the reactive group of the n-type metal oxide fine particles.

* * * * *